US008562758B2

(12) United States Patent
Fujisawa et al.

(10) Patent No.: US 8,562,758 B2
(45) Date of Patent: Oct. 22, 2013

(54) AUSTENITIC-FERRITIC STAINLESS STEEL

(75) Inventors: Mitsuyuki Fujisawa, Chiyoda-ku (JP); Yoshihiro Yazawa, Chiyoda-ku (JP); Yasushi Kato, Chiyoda-ku (JP); Osamu Furukimi, Chiyoda-ku (JP)

(73) Assignee: JFE Steel Corporation (JP)

( * ) Notice: Subject to any disclaimer, the term of this patent is extended or adjusted under 35 U.S.C. 154(b) by 0 days.

(21) Appl. No.: 10/587,222

(22) PCT Filed: Jan. 27, 2005

(86) PCT No.: PCT/JP2005/001555

§ 371 (c)(1),
(2), (4) Date: Jul. 24, 2006

(87) PCT Pub. No.: WO2005/073422

PCT Pub. Date: Aug. 11, 2005

(65) Prior Publication Data

US 2007/0163679 A1 Jul. 19, 2007

(30) Foreign Application Priority Data

Jan. 29, 2004 (JP) ..... 2004-021283
Mar. 16, 2004 (JP) ..... 2004-073862
Mar. 16, 2004 (JP) ..... 2004-074033

(51) Int. Cl.
*C22C 38/38* (2006.01)

(52) U.S. Cl.
USPC ..... 148/325; 148/330; 148/331; 148/332; 148/337; 420/65; 420/66

(58) Field of Classification Search
USPC ..... 148/325, 329, 336, 337; 420/34, 65, 72, 420/73, 74, 120, 128
See application file for complete search history.

(56) References Cited

U.S. PATENT DOCUMENTS 3,736,131 A 5/1973 Espy
3,861,908 A 1/1975 Bressanelli (Continued)

FOREIGN PATENT DOCUMENTS

EP 1352982 A2 * 10/2003
EP 1 327 008 B1 2/2006

(Continued)

OTHER PUBLICATIONS

Durand-Charre, Madeleine, Microstructure of Steels and Cast Irons, Springer, 2003. (Ch. 19—Stainless Steels).*

(Continued)

*Primary Examiner* — Roy King
*Assistant Examiner* — Vanessa Luk
(74) *Attorney, Agent, or Firm* — DLA Piper LLP (US)

(57) ABSTRACT

A low Ni and high N austenitic-ferritic stainless steel is disclosed. It includes an austenitic-ferritic stainless steel having high formability and punch stretchability, crevice corrosion resistance, corrosion resistance at welded part, or excellent intergranular corrosion resistance, from a stainless steel structured by mainly austenite phase and ferrite phase, and consisting essentially of 0.2% or less C, 4% or less Si, 12% or less Mn, 0.1% or less P, 0.03% or less S, 15 to 35% Cr, 3% or less Ni, and 0.05 to 0.6% N, by mass, by adjusting the percentage of the austenite phase in a range from 10 to 85%, by volume. Furthermore, it includes an austenitic-ferritic stainless steel having higher formability by adjusting the amount of (C+N) in the austenite phase to a range from 0.16 to 2% by mass.

4 Claims, 10 Drawing Sheets

(56) References Cited

U.S. PATENT DOCUMENTS

| | | | | | |
|---|---|---|---|---|---|
| 4,721,600 | A | * | 1/1988 | Maehara et al. | 420/57 |
| 5,254,184 | A | * | 10/1993 | Magee et al. | 148/325 |
| 5,413,754 | A | * | 5/1995 | Yazawa et al. | 420/41 |
| 6,096,441 | A | | 8/2000 | Hauser et al. | |
| 6,344,094 | B1 | * | 2/2002 | Hineno et al. | 148/325 |
| 2003/0172999 | A1 | * | 9/2003 | Alfonsson et al. | 148/325 |

FOREIGN PATENT DOCUMENTS

| | | | | |
|---|---|---|---|---|
| ES | 2182647 | A1 | * | 3/2003 |
| JP | 56-051222 | | | 12/1981 |
| JP | 02 305940 | A | | 12/1990 |
| JP | 06-256843 | | * | 9/1994 |
| JP | 8-20843 | A | | 1/1996 |
| JP | 09-209092 | | * | 8/1997 |
| JP | 10-219407 | A | | 8/1998 |
| JP | 11-71643 | A | | 3/1999 |
| JP | 2000-239799 | A | | 9/2000 |
| JP | 2002-194511 | A | | 7/2002 |

OTHER PUBLICATIONS

Holt, John M. (Tim), "Uniaxial Tension Testing," ASM Handbook, vol. 8: Mechanical Testing and Evaluation (2000), pp. 124-142.*

Computer-generated translation of JP 10-218407 (Matsuzaki et al.), published originally in the Japanese language on Aug. 18, 1998.*

Computer-generated English translation of EP1352982, originally published in the German language on Oct. 15, 2003.*

Professional translation of ES2182647 (Fernandez de Castillo y Valderrama et al.), published originally in Spanish on Mar. 1, 2003.*

* cited by examiner

AUSTENITIC-FERRITIC STAINLESS STEEL

RELATED APPLICATION

This is a §371 of International Application No. PCT/JP2005/001555, with an international filing date of Jan. 27, 2005 (WO 2005/073422 A1, published Aug. 11, 2005), which is based on Japanese Patent Application Nos. 2004-021283, filed Jan. 29, 2004, 2004-074033, filed Mar. 16, 2004 and 2004-073862, filed Mar. 16, 2004.

TECHNICAL FIELD

The invention relates to a low Ni and high N stainless steel having an austenite and ferrite (two-phase) structure.

BACKGROUND

Stainless steels are used in wide fields including automobile members, construction members, and kitchenware as high corrosion resistance materials. As of these applications, wheel cap of automobile, and the like, request a material having both high punch stretchability and high crevice corrosion resistance. Stainless steels are generally grouped, based on the structure of the steel, into four categories: austenitic stainless steels, ferritic stainless steels, austenitic-ferritic stainless steels, and martensitic stainless steels. As of these stainless steels, the austenitic stainless steels represented by SUS304 and SUS301 (specified by Japanese Industrial Standard (JIS)) are most widely used owing to their excellent corrosion resistance and workability. Accordingly, the austenitic stainless steel sheets are generally adopted by the wheel cap of automobile.

Compared with other types of stainless steels, however, the austenitic stainless steels have a drawback of high cost because of large content of expensive Ni, though the steels have high workability.

Furthermore, the austenitic stainless steels likely induce seasoned cracks on working to near the forming limit and have high sensitization to stress corrosion cracking (SCC). As a result, the austenitic stainless steels have a problem in application to portions such as fuel tanks where the requirement for safety is extremely severe. Regarding the martensitic stainless steels, they are inferior in ductility, punch stretchability, and corrosion resistance, though the strength is high, thereby failing to apply them to press-forming.

The austenitic stainless steels represented by SUS301 face a criticism of occurrence of problems, in some cases, such as insufficient corrosion resistance, inducing, in particular, corrosion at gaps between wheel and cap of automobile in coastal zones owing to the salt scattered in wind, and in snow zones owing to the snow-melting salt. In addition, as described above, since seasoned cracks appear on working to near the forming limit, there is a problem of difficulty in application of the austenitic stainless steels to a member having complex shape. Furthermore, the austenitic stainless steels have a problem of high cost because of the Ni content at 6% or more in general grades.

On the other hand, ferritic stainless steels have excellent characteristics. That is, they can increase the corrosion resistance and the crevice corrosion resistance by increasing the Cr content, and they induce very little seasoned cracks and stress corrosion cracking. The ferritic stainless steels, however, have a drawback of inferior workability, particularly inferior balance of strength and ductility, to the austenitic stainless steels. In addition, compared with austenitic stainless steels, the ferritic stainless steels have a problem of very poor punch stretchability and difficulty in forming. The martensitic stainless steels are insufficient in both the punch stretchability and the crevice corrosion resistance.

To this point, there have been proposed technologies for improving the workability of ferritic stainless steels. For example, JP-A-08-020843, (the term "JP-A" referred to herein signifies the "Unexamined Japanese Patent Publication"), discloses a Cr steel sheet, or a ferritic stainless steel sheet containing 5 to 60% by weight of Cr, having excellent deep drawability, by decreasing the content of C and N, while adding appropriate amount of Ti and Nb, and a method for manufacturing the Cr steel sheet. Since, however, the steel sheet of JP-A-08-020843 decreases the content of C and N to 0.03% by weight or less and 0.02% by weight or less, respectively to improve the deep drawability, the steel sheet is poor in the strength and is insufficient in the improvement of ductility. That is, the steel sheet has a problem of poor balance of strength and ductility. As a result, when the steel sheet according to JP-A-08-020843 is applied to an automobile member, the necessary sheet thickness to attain the required strength of the member increases, which fails to contribute to weight saving. In addition, the steel sheet has a problem of inapplicability to severe working uses such as punch stretching, deep drawing, and hydraulic forming.

In this regard, the austenitic-ferritic stainless steels which are positioned between the austenitic stainless steels and the ferritic stainless steels have drawn attention in recent years. The austenitic-ferritic stainless steels have excellent corrosion resistance. Owing to the excellent strength and corrosion resistance, the austenitic-ferritic stainless steels are used as the anti-corrosive materials in high-chloride environment such as seawater and in severe corrosive environment such as oil wells. The SUS329 group austenitic-ferritic stainless steels specified by JIS, however, are expensive owing to the content of expensive Ni by 4% or more, by mass (the same is applied in the following), and have a problem of consuming large amount of valuable Ni resource.

Responding to the problem, JP-A-11-071643 discloses an austenitic-ferritic stainless steel sheet having high tensile elongation, by limiting the Ni content to a range above 0.1% and below 1%, and by controlling the austenite stability index (IM index: 551-805(C+N) %-8.52Si %-8.57Mn %-12.51Cr %-36.02Ni %-34.52Cu %-13.96Mo %) to a range from 40 to 115.

There are other trials of decreasing the Ni content in austenitic stainless steels and austenitic-ferritic stainless steels by the addition of large amount of N instead of Ni. An example of these trials is introduced by Yasuyuki Katada, "Manufacture of high N steel by pressurized electro-slag remelting (ESR) process", Ferrum, vol. 7, p. 848, (2002), describing the method for manufacturing austenitic stainless steel and austenitic-ferritic stainless steel containing substantially no Ni, by the addition of large amount of N.

Alternatively, J. Wang et al. discloses an austenitic-ferritic stainless steel with inexpensive alloying cost, containing substantially no Ni, in "NICKEL-FREE DUPLEX STAINLESS STEELS", Scripta Materialia, vol. 40, No. 1, pp. 123-129, (1999).

However, the austenitic-ferritic stainless steel sheet disclosed in JP-A-11-071643 does not attain satisfactory ductility, though it does improve the ductility to some extent, and has no satisfactory deep drawability. Consequently, the austenitic-ferritic stainless steel of JP-A-11-071643 has problems of difficulty in application to the uses subjected to an extreme degree of punch stretching and hydraulic forming, and of difficulty also in application to the uses subjected to an extreme degree of deep drawing.

Furthermore, the austenitic-ferritic stainless steel disclosed in JP-A-11-071643 is insufficient in the crevice corrosion resistance because of the large amount of Mn, though it shows high tensile elongation, and the steel has a problem that the punch stretchability is not known. The steel has another problem of poor corrosion resistance at welded part. That is, since the austenitic-ferritic stainless steels are subjected to welding before use depending on their uses, they have to have excellent corrosion resistance at welded part. Since, however, the austenitic-ferritic stainless steel according to JP-A-11-071643 contains 0.1 to 0.3% N which is an austenite-forming element to decrease the Ni amount, the N becomes solid solution at high temperatures at the welded part and surrounding heat-affecting zone, which N solid solution then likely precipitates as a chromium nitride, thereby generating a chromium-depleted zone to deteriorate the corrosion resistance.

According to JP-A-11-071643, furthermore, N is added by the amounts from 0.1 to 0.3% by weight as an austenite-forming element instead of decreasing the Ni content. Consequently, when the cooling rate after the solution annealing is slow, the N precipitates as a chromium nitride to deteriorate the corrosion resistance. The phenomenon is what is called the problem of sensibility, or the deterioration of corrosion resistance owing to the formation of chromium carbide and chromium nitride at grain boundaries, (hereinafter referred to as the sensitization).

Specifically, when finish-annealed sheets having 1.5 mm or larger thickness were air-cooled, the slow cooling rate of the material induced sensitization during the cooling step, thus the corrosion resistance became insufficient in some cases.

Even the materials having less than 1.5 mm in the final sheet thickness raised a problem caused by the sensitization occurred during the annealing of hot-rolled sheet as an intermediate step. That is, the finish-annealed sheets having less than 1.5 mm of thickness are manufactured by, after steelmaking and casting, the successive steps of hot rolling, annealing, descaling by pickling, cold rolling, and finish-annealing. In the course of these manufacturing steps, since the material becomes sensible during the air cooling after the annealing of hot-rolled sheet (1.5 to 7 mm in sheet thickness during the annealing), the grain boundaries are preferentially corroded during the succeeding pickling step, and the preferentially-corroded grooves do not vanish even in the cold rolling step, which raises a problem of significantly deteriorating the surface property of the final finish-annealed sheet. To improve the surface property, it is effective to grind the surface after the annealing of hot-rolled sheet using a grinder. The grinding, however, significantly increases the cost.

With the background described above, there is wanted a material that is sensitized very little during cooling step after the solid solution heat treatment.

The means which is disclosed by Yasuyuki Katada, "Manufacture of high N steel by pressurized electro-slag remelting (ESR) process", Ferrum, vol. 7, p. 848, (2002), contains many cost-increasing causes on operation, even as a simple Ni-decreasing means, such as the necessity of large apparatus for performing pressure melting, and the necessity of electrode for preliminarily melting material. Furthermore, the means has to attain both the punch stretchability and the crevice corrosion resistance even when simply the Ni is replaced by N.

Also for a means disclosed by J. Wang et al. in "NICKEL-FREE DUPLEX STAINLESS STEELS", Scripta Materialia, vol. 40, No. 1, pp. 123-129, (1999), since the simultaneous addition of large amount of Mn (as large as 10% by mass) and N (0.35 to 0.45% by mass) to decrease the amount of Ni is done, the hot workability is not sufficient and the cracks and flaws likely occur during hot working. The disclosed means has many cost-increasing causes such as necessity of surface grinding and of steel cut-off, through the alloy cost is low.

An object of the present invention is to provide an austenitic-ferritic stainless steel which has high formability with excellent ductility and deep drawability.

Another object of the present invention is to solve the above-described problems in the related art, and to provide a austenitic-ferritic stainless steel which has both the high punch stretchability and the high crevice corrosion resistance while decreasing the amount of Ni.

A further object of the present invention is to solve the above-described problems in the related art, and to provide a austenitic-ferritic stainless steel which has excellent corrosion resistance at welded part at a relatively low cost while saving the Ni resources.

A still another object of the present invention is to solve the above-described problems, and to provide an austenitic-ferritic stainless steel sheet which has excellent intergranular corrosion resistance.

SUMMARY

We evaluated the formability on stainless steels having various ingredients and steel structures to improve the formability of stainless steels other than austenitic stainless steels containing expensive Ni.

The evaluation derived a finding that austenitic-ferritic stainless steels show particularly high ductility in some cases. We studied the causes of the phenomenon in detail, and found that the percentage of austenite phase and the content of C and N in the austenite phase significantly affect the ductility, and that, in particular, further high ductility can be attained by adjusting the strain stability of the austenite phase to an appropriate range, which strain stability of austenite phase is defined by the content of C, N, Si, Mn, Cr, Ni, Cu, and Mo in the austenite phase. Furthermore, we found that the austenitic-ferritic stainless steel which gives high ductility is also superior in deep drawability.

We also conducted detail study of various kinds of austenitic-ferritic stainless steels containing 1% by mass or less Ni and 0.05% by mass or more N.

The study derived the finding that austenitic-ferritic stainless steels containing 2% by mass or less Mn improve the punch stretchability and the crevice corrosion resistance.

In addition, the study found that the corrosion resistance at welded part improves in the austenitic-ferritic stainless steels containing 4 to 12% Mn by mass.

Furthermore, the study found that the Si content of the steel affects the precipitation behavior of chromium nitride, and derived the finding that the intergranular corrosion resistance improves when the Si content of steel is 0.4% by mass or less.

That is, the austenitic-ferritic stainless steels include at least the following:

1. The austenitic-ferritic stainless steel has a metal structure which contains ferrite phase and austenite phase. The amount of (C+N) in the austenite phase is in a range from about 0.16 to about 2% by mass, and the volume percentage of the austenite phase is in a range from about 10 to about 85%.

2. The austenitic-ferritic stainless steel according to 1 has about 48% or larger total elongation determined by tensile test.

3. The austenitic-ferritic stainless steel according to 1 or 2 contains about 0.2% or less C, about 4% or less Si, about 12% or less Mn, about 0.1% or less P, about 0.03% or less S, about 15 to about 35% Cr, about 3% or less Ni, about 0.05 to about 0.6% N, by mass, and balance of Fe and inevitable impurities.

4. The austenitic-ferritic stainless steel according to 3 contains about 10% or less Mn, about 1 to about 3% Ni, by mass, and balance of Fe and inevitable impurities.

5. The austenitic-ferritic stainless steel according to 3 contains about 1.2% or less Si, about 2% or less Mn, about 1% or less Ni, by mass, and balance of Fe and inevitable impurities.

6. The austenitic-ferritic stainless steel according to 3 contains about 1.2% or less Si, about 4 to about 12% Mn, about 1% or less Ni, by mass, and balance of Fe and inevitable impurities.

7. The austenitic-ferritic stainless steel according to 3 contains about 0.4% or less Si, about 2 to about 4% Mn, about 1% or less Ni, by mass, and balance of Fe and inevitable impurities.

8. An austenitic-ferritic stainless steel showing excellent deep drawability is a stainless steel having an austenite and ferrite two-phase structure, containing about 0.2% or less C, about 4% or less Si, about 10% or less Mn, about 0.1% or less P, about 0.03% or less S, about 15 to about 35% Cr, about 1 to about 3% Ni, about 0.05 to about 0.6% N, by mass, and balance of Fe and inevitable impurities. The amount of (C+N) in the austenite phase is in a range from about 0.16 to about 2% by mass, and the volume percentage of the austenite phase is in a range from about 10 to about 85%.

9. An austenitic-ferritic stainless steel showing excellent punch-stretchability and crevice corrosion resistance contains about 0.2% or less C, about 1.2% or less Si, about 2% or less Mn, about 0.1% or less P, about 0.03% or less S, about 15 to about 35% Cr, about 1% or less Ni, about 0.05 to about 0.6% N, by mass, and balance of Fe and inevitable impurities. The percentage of the austenite phase in the metal structure is in a range from about 10 to about 85% by volume.

10. An austenitic-ferritic stainless steel showing excellent corrosion resistance at welded part contains about 0.2% or less C, about 1.2% or less Si, about 4 to about 12% Mn, about 0.1% or less P, about 0.03% or less S, about 15 to 35% Cr, about 1% or less Ni, about 0.05 to about 0.6% N, by mass, and balance of Fe and inevitable impurities. The percentage of the austenite phase is in a range from about 10 to about 85% by volume.

11. An austenitic-ferritic stainless steel showing excellent intergranular corrosion resistance contains about 0.2% or less C, about 0.4% or less Si, about 2 to about 4% Mn, about 0.1% or less P, about 0.03% or less S, about 15 to about 35% Cr, about 1% or less Ni, about 0.05 to about 0.6% N, by mass, and balance of Fe and inevitable impurities. The percentage of the austenite phase is in a range from about 10 to about 85% by volume.

12. The austenitic-ferritic stainless steel according to any of 3 to 11, wherein the stainless steel further contains one or more of about 4% or less Mo and about 4% or less Cu, by mass.

13. The austenitic-ferritic stainless steel according to any of 3 to 12, wherein the stainless steel further contains about 0.5% or less V, by mass.

14. The austenitic-ferritic stainless steel according to any of 3 to 13, wherein the stainless steel further contains about 0.1% or less Al, by mass.

15. The austenitic-ferritic stainless steel according to any of 3 to 14, wherein the stainless steel further contains one or more of about 0.01% or less B, about 0.01% or less Ca, about 0.01% or less Mg, about 0.1% or less REM, and about 0.1% or less Ti, by mass.

16. The austenitic-ferritic stainless steel according to any of 9 to 15 has the amount of (C+N) in the austenite phase in a range from about 0.16 to about 2% by mass.

There is provided an austenitic-ferritic stainless steel which has high formability giving excellent ductility and deep drawability at low cost without containing large amount of expensive Ni. Since the austenitic-ferritic stainless steel gives excellent formability, the stainless steel is suitable for the uses subjected to severe punch stretching and deep drawing, and to hydraulic forming such as hydroforming, in such fields of automobile members, building members, and kitchenware.

Owing to the low Ni content, the austenitic-ferritic stainless steel has excellent punch stretchability and crevice corrosion resistance in spite of its relatively low cost. Consequently, the austenitic-ferritic stainless steel allows fabricating complex shape works such as automobile wheel cap economically without fear of seasoned cracks.

In addition, we provide an austenitic-ferritic stainless steel which has excellent corrosion resistance at welded part while saving the Ni resource. With the characteristic, the corrosion resistant materials become available economically in high-chloride environment such as seawater, in severe corrosive environment such as oil wells, and the like.

Furthermore, we provide an austenitic-ferritic stainless steel sheet having excellent corrosion resistance even with low Ni content and high N content owing to the sensitization to prevent deterioration in the corrosion resistance. Since, furthermore, the stainless steel sheet has low Ni content, the steel sheet is preferable in view of environmental protection and of economy.

DETAILED DESCRIPTION

Figure 1:
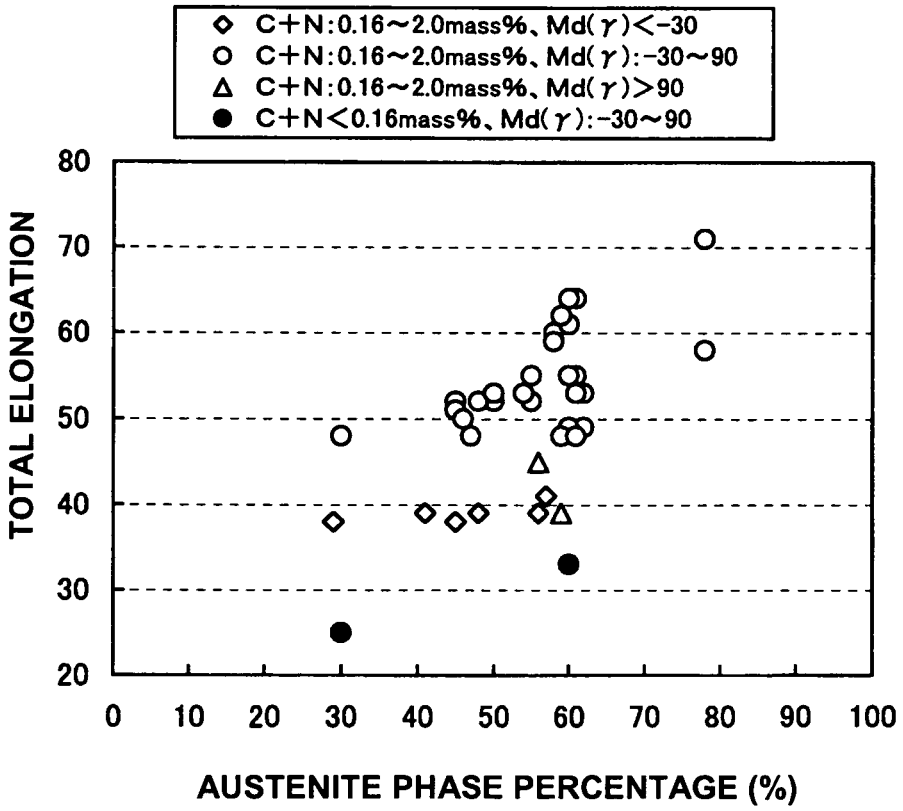
FIG. 1 is a graph showing the effect of the amount of (C+N) in the austenite phase and the percentage of austenite phase on the total elongation of the austenitic-ferritic stainless steels.

The description of selected, representative stainless steels is given below.

(1) Austenitic-Ferritic Stainless Steel Having High Formability with Excellent Ductility and Deep Drawability The stainless steel is an austenitic-ferritic stainless steel composed mainly of austenite phase and ferrite phase. We found that the volume percentage of the austenite phase and the content of C and N in the austenite phase significantly affect the formability of the austenitic-ferritic stainless steel composed mainly of the above two phases, and on the defining of their optimum values. The steel structure other than the austenite phase and the ferrite phase is occupied mainly by martensite phase.

The austenitic-ferritic stainless steel has 10 to 85% by volume of the austenite phase to the total steel structure. If the percentage of austenite phase is smaller than 10%, the amount of austenite phase excellent in ductility becomes small so that high formability cannot be attained. If the percentage of austenite phase exceeds 85%, stress corrosion cracking (SCC) appears. Therefore, a preferred range of the percentage of austenite phase is from 15 to 80% by volume.

The percentage of austenite phase is the volume percentage of austenite in the structure, and can be determined typically by observing the steel structure using a microscope, and by determining the percentage of austenite phase in the structure using linear analysis or areal analysis. Specifically, when a sample is polished, and then is etched in a red prussiate solution (potassium ferricyanide ($K_3[Fe(CN)_6]$) 30 g+potassium hydroxide (KOH) 30 g+water ($H_2O$) 60 ml), observation using a light microscope identifies the ferrite phase in gray, and the austenite phase and the martensite phase in white. Thus, the percentage of gray zone and of white zone, respectively, is determined by image analysis to adopt the percentage of white zone as the percentage of austenite phase. In strict meaning, however, the method cannot separately identify between the austenite phase and the martensite phase, thus the white zone may include the martensite phase other than the austenite phase. Nevertheless, even in the case of inclusion of martensite phase in the white zone, the target effect is attained if only the percentage of austenite phase determined by the method and other conditions are satisfied.

The above-described volume percentage of the austenite phase can be controlled by adjusting the steel composition and the annealing condition (temperature and time) in the final annealing step. Specifically, the percentage of austenite phase increases with the decrease in Cr, Si, and Mo contents and with the increase in C, N, Ni, and Cu contents. Excessively high annealing temperature decreases the percentage of austenite phase. On the other hand, excessively low annealing temperature induces precipitation of C and N as carbide and nitride to decrease the solid solution amount, which deteriorates the contribution to the formation of austenite phase, thereby also decreasing the percentage of austenite phase. That is, depending on the steel composition, there is a temperature range to attain the maximum percentage of austenite phase, and the temperature range with the composition is from 700° C. to 1300° C. Although longer annealing time is more preferable because the percentage of austenite phase comes close to that in equilibrium state which is determined by the steel composition and the temperature, the time about 30 seconds or more is sufficient.

The austenitic-ferritic stainless steel contains 0.16 to 2% by mass of the amount of (C+N) in the austenite phase. If the amount of (C+N) in the austenite phase is smaller than 0.16% by mass, the strength of strain-induced martensite phase becomes small, which fails to attain sufficient formability. If the amount of (C+N) exceeds 2% by mass, large amount of carbide and nitride precipitates during cooling stage after the annealing, which rather inversely affects the ductility. A preferable range of the amount of (C+N) is from 0.2 to 2% by mass.

Control of the amount of (C+N) in the austenite phase can be done by adjusting the composition and the annealing condition (temperature and time) of steel. Since the relation between the composition and the annealing condition of steel is affected by many steel ingredients such as C, Si, Mn, Cr, Ni, Cu, and Mo, there is no definite defining correlation. However, increased amount of C, N, and Cr in the steel tends to increase the amount of C and N in the austenite phase. When the composition of steel is the same, smaller percentage of austenite phase after annealing for solid-solution forming likely more enriches C and N in the austenite phase. Determination of C and N concentration in the austenite phase can be done by EPMA, for example.

Although there is no detail analysis of the causes of the effect of volume percentage of austenite phase and of the amount of (C+N) in the austenite phase on the formability, we speculate the mechanism of the phenomenon as follows.

When a steel is subjected to tensile deformation, the steel generally induces uniform deformation, followed by generating local necking (constriction), then results in fracture. Since, however, the stainless steels herein have austenite phase, once a fine necking occurs, the austenite phase at the necking part begins strain-induced transformation to martensite phase to become harder than other parts. As a result, the necking at the part stops its progression. Instead of the progress of necking at the part, deformation on other parts proceeds to give uniform deformation over the steel, thereby providing high ductility. In particular, the stainless steels herein having large amount of (C+N) in the austenite phase has high hardness of martensite phase generated at necking part, compared with other stainless steels containing smaller amount of (C+N) in the austenite phase even with the same percentage of austenite phase, thus the effect of improving ductility by the strain-induced martensite phase is present. In particular, C and N in the austenite phase significantly vary their degree of enriching into the austenite phase depending on their content in the steel and on the heat treatment condition. Since the austenite phase relates to the formability, higher percentage of austenite phase improves more the formability. Accordingly, if the steel composition and the heat treatment condition are adjusted to increase the percentage of austenite phase, and if the amount of (C+N) in the austenite phase is increased, the austenite phase can be stabilized, and appropriate degree of stain-induced transformation is obtained during working, thereby attaining excellent workability. To do this, it is required to establish 10% or more of the percentage of austenite phase, and 0.16% by mass or more of the amount of (C+N) in the austenite phase. If the amount of (C+N) in the austenite phase is smaller than 0.16% by mass, the austenite phase becomes unstable, and a large part of the austenite phase transforms to martensite phase during working to deteriorate the ductility, thus the increased percentage of austenite phase cannot improve the press-formability. The limitation of the percentage of austenite phase to 85% or smaller is given because higher than 85% thereof increases the SCC sensitization, which is unfavorable.

The stainless steel sheet may be an austenitic-ferritic stainless steel sheet containing particularly 3% by mass or less Ni, composed mainly of austenite phase and ferrite phase. That is, we found significant effect of the percentage of austenite phase and the amount of (C+N) in the austenite phase in the austenitic-ferritic stainless steel sheet containing 3% by mass or less Ni on the press formability.

Furthermore, we found that, in the austenitic-ferritic stainless steels herein, further high ductile characteristic can be attained, or 48% or larger total elongation can be attained even at 0.8 mm in sheet thickness, by controlling the strain-induced martensite index (Md(γ)) of austenite phase to a range from −30 to 90. The strain-induced martensite index (Md(γ)) of austenite phase is defined by the formula (I) as the function of content of C, N, Si, Mn, Cr, Ni, Cu, and Mo in the austenite phase:

$$Md(\gamma)=551-462(C(\gamma)+N(\gamma))-9.2Si(\gamma)-8.1Mn(\gamma)-13.7Cr(\gamma)-29Ni(\gamma)-29Cu(\gamma)-18.5Mo(\gamma) \quad (1)$$

where, C(γ), N(γ), Si(γ), Mn(γ), Ce(γ), Ni(γ), Cu(γ), and Mo(γ) are respectively C content (% by mass), N content (% by mass), Si content (% by mass), Mn content (% by mass), Mo content (% by mass), Ni content (% by mass), Cu content (% by mass), and Cr content (% by mass) in the austenite phase.

Above Md(γ) is an index giving the easiness of strain-induced martensite transformation for the austenite phase undergoing working. Higher index suggests easier occurrence of martensite transformation during working. The range from −30 to 90 for the Md(γ) is preferred because of the reasons given below. If the Md(γ) is smaller than −30, the strain-induced martensite transformation is difficult to begin. Therefore, at the beginning of fine necking, the amount of strain-induced martensite generated at the fine necking part is small. If the Md(γ) exceeds 90, the austenite phase almost completed the martensite transformation over the whole steel before the fine necking begins. As a result, when the fine necking begins, the amount of austenite phase as the source of strain-induced martensite transformation is left small. Consequently, it is presumed that only when the Md(γ) is controlled to the range from −30 to 90, the amount of martensite generated at the necking part on beginning the fine necking is optimized to give very high ductility.

As described above, the austenitic-ferritic stainless steels herein have not only excellent ductility, but also high deep drawability. The reason of the superior characteristics is presumably as follows. During the deep drawing, particularly at a corner where the strain concentrates to readily induce cracks, the hardening caused by the strain-induced martensite transformation occurs to an appropriate degree by the same reason with the above-described improvement effect of the percentage of austenite phase and the amount of (C+N) in the austenite phase on the ductility, thus improving the ductility, thereby suppressing the local deformation.

The following is the description of reasons to limit the composition of austenitic-ferritic stainless steel sheet according to the present invention.

C: 0.2% by mass or less

Carbon is an important element to increase the percentage of austenite phase and to increase the stability of austenite phase by enriching itself in the austenite phase. To attain the effect, 0.003% by mass or more of the C content is preferred. If, however, the C content exceeds 0.2% by mass, the heat treatment temperature to form C solid solution significantly increases, which deteriorates the productivity. Accordingly, the C content is limited to 0.2% by mass or less. Preferably the C content is less than 0.15% by mass. In view of improvement in the stress corrosion cracking resistance, the C content is more preferably less than 0.10% by mass, and most preferably 0.05% by mass or less. If the C content is 0.2% by mass or less, the corrosion resistance at welded part becomes excellent at any of weld bead, heat affecting zone, and mother material. The excellent corrosion resistance at these parts can be confirmed in Example 4 described later. If, however, the C content is 0.10% by mass or more, the stress corrosion cracking resistance is significantly deteriorated. Therefore, the C content is specified to 0.2% by mass or less, and when the stress corrosion cracking resistance is emphasized, the C content is limited to less than 0.10% by mass, preferably 0.05% by mass or less. The reason of the specified range can be confirmed in Table 10 and Table 11 in Example 5 described later.

Si: 4% by mass or less

Silicon is an element added as a deoxidizer. To attain the deoxidization effect, 0.01% by mass or more of the Si content is preferred. If, however, the Si content exceeds 4% by mass, the steel strength increases to deteriorate the cold-workability. Therefore, the Si content is specified to 4% by mass or less. From the point of hot-workability, the Si content is preferably 1.2% by mass or less. From the point to prevent the deterioration of corrosion resistance caused by the sensitization (deterioration of corrosion resistance by the formation of chromium carbide and chromium nitride at grain boundaries), the Si content is limited more preferably to 0.4% by mass or less.

Mn: 12% by mass or less

Manganese is effective as an element of deoxidizer and for adjusting Md(γ) of austenite phase, and can be added at need. To obtain the effect, 0.01% by mass or more of the Mn content is preferred. If, however, the Mn content exceeds 12% by mass, the hot-workability deteriorates, thus the Mn content is preferably limited to 12% by mass or less, more preferably 10% by mass or less, further preferably 8% by mass or less, and most preferably 7% by mass or less.

P: 0.1% by mass or less

Phosphorus is an element harmful to hot-workability and crevice corrosion resistance. In particular, when the P content exceeds 0.1% by mass, the inverse effect of P becomes significant. Therefore, the P content is preferably limited to 0.1% by mass or less, and more preferably 0.05% by mass or less.

S: 0.03% by mass or less

Sulfur is an element harmful to hot-workability. Particularly when the S content exceeds 0.03% by mass, the inverse effect of S becomes significant. Consequently, the S content is preferably limited to 0.03% by mass or less, and more preferably 0.02% by mass or less.

Cr: 15 to 35% by mass

Chromium is the most important element for providing stainless steel with corrosion resistance, and less than 15% by mass of Cr cannot attain sufficient corrosion resistance and crevice corrosion resistance. Since Cr is also an element of increasing ferrite phase, larger than 35% by mass of Cr makes the steel difficult to form austenite phase in the steel. Accordingly, the Cr content is preferably limited to a range from 15 to 35% by mass, more preferably from 17 to 30% by mass, and most preferably from 18 to 28% by mass.

Ni: 3% by mass or less

Nickel is an austenite-forming element and is an element effective in improving the crevice corrosion resistance. If, however, the Ni content exceeds 3% by mass, the amount of Ni in the ferrite phase increases to deteriorate the ductility of ferrite phase, and increases the cost. Therefore, the Ni content is preferably limited to 3% by mass or less, and more preferably 2% by mass or less. In view of improving the low temperature toughness, the Ni content is preferably limited to 0.1% by mass or more. For the improvement o crevice corrosion resistance, the Ni content is preferably limited to 1% by mass or more.

N: 0.05 to 0.6% by mass

Similar to C, N is an element which increases the percentage of austenite phase and enriches itself in austenite phase, thus stabilizing the austenite phase. If, however, the N content exceeds 0.6% by mass, blow-holes appear during casting, and the stable manufacturing becomes difficult. Furthermore, uneconomical means such as pressure-melting becomes necessary. On the other hand, if the N content is less than 0.05% by mass, the enrichment of N in the austenite phase becomes insufficient. Therefore, the N content is preferably limited to a range from 0.05 to 0.6% by mass, and more preferably from 0.1 to 0.4% by mass.

From the point of austenite-phase formation, the N content is further preferably limited to 0.18% by mass or more. From the point of hot-workability, the N content is further preferably limited to 0.34% by mass or less.

The austenitic-ferritic stainless steel can contain Cu and Mo by the amounts given below, other than the above-ingredients.

Cu: 4% by mass or less

Copper can be added to increase the corrosion resistance, at need. To attain the effect, 0.1% by mass or more of the Cu content is preferred. If, however, the Cu content exceeds 4% by mass, the hot-workability deteriorates. Accordingly, the Cu content is preferably limited to 4% by mass or less, and more preferably 2% by mass or less.

Mo: 4% by mass or less

Molybdenum can be added to increase the corrosion resistance, at need. To attain the effect, 0.1% by mass or more of the Mo content is preferred. If, however, the Mo content exceeds 4% by mass, the effect saturates. Accordingly, the Mo content is preferably limited to 4% by mass or less, and more preferably 2% by mass or less.

Furthermore, the stainless steel may contain, other than the above-ingredients, V, Al, B, Ca, Mg, REM, and Ti by the amounts given below.

V: 0.5% by mass or less

Since V is an element to refine the steel structure and to increase the strength, it can be added to the steel, at need. To attain the effect, V is preferably added by 0.005% by mass or more. If, however, the V content exceeds 0.5% by mass, the heat treatment temperature to make C and N solid solution becomes significantly high, and the productivity deteriorates. If the V content exceeds 0.5% by mass, the reduction of precipitation of V compounds becomes difficult even when the annealing temperature is increased, thus the punch stretchability deteriorates. Accordingly, the V content is preferably limited to 0.5% by mass or less, and more preferably 0.2% by mass or less.

Al: 0.1% by mass or less

Aluminum is a strong deoxidizer, and can be added at need. To attain the effect, 0.003% by mass or more of the Al content is preferred. If, however, the Al content exceeds 0.1% by mass, the Al forms nitride to induce occurrence of surface flaw. Accordingly, the Al content is preferably limited to 0.1% by mass or less, and more preferably 0.02% by mass or less.

One or more of 0.01% by mass or less B, 0.01% by mass or less Ca, 0.01% by mass or less Mg, 0.1% by mass or less REM, and 0.1% by mass or less Ti Boron, Ca, and Mg can be added at need as ingredients to improve the hot-workability. To attain the effect, their content is preferably limited to 0.0003% by mass or more, more preferably 0.0001% by mass or more, and most preferably 0.002% by mass or more. If, however, their content exceeds 0.01% by mass, the corrosion resistance deteriorates. Therefore, each of their contents is preferably limited to 0.01% by mass or less, and more preferably 0.005% by mass or less. Similarly, REM and Ti can be added at need as ingredients to improve the hot-workability. To attain the effect, 0.002% by mass or more is preferred. If, however, their content exceeds 0.1% by mass, the corrosion resistance deteriorates. Therefore, each of their contents is preferably limited to 0.1% by mass or less, and more preferably 0.05% by mass or less. The above REM represents the rare earth elements such as La and Ce.

Nb: 2% by mass or less

Niobium can be added as an element to suppress sensitization (deterioration of corrosion resistance caused by the formation of chromium carbide and chromium nitride at grain boundaries). To attain the effect, 0.01% by mass or more of the Nb content is preferred. If, however, the Nb content exceeds 2% by mass, large amount of niobium carbide and niobium nitride, and the solid solution C and N in the steel is consumed, which is not favorable.

Balance of above-ingredients in the steel is Fe and inevitable impurities. As of these impurities, O (oxygen) is preferably limited to 0.05% by mass or less from the point of prevention of occurrence of surface flaws caused by inclusions.

Regarding the method for manufacturing the steels herein, it is important to adjust the steel composition and the annealing condition (temperature and time) in the final annealing step, as described above, to bring the volume percentage of austenite phase to a range from 10 to 85%, or further to bring the amount of (C+N) in the austenite phase to a range from 0.16 to 2% by mass.

Specifically, lower content of Cr, Si, and Mo, and higher content of C, N, Ni, and Cu increase more the percentage of austenite phase. Regarding the annealing temperature, excessively high annealing temperature decreases the percentage of austenite phase, and excessively low annealing temperature induces precipitation of C and N as carbide and nitride to decrease the amount of solid solution, which decreases the contribution to the formation of austenite phase, thereby also decreasing the percentage of austenite phase. That is, there is a temperature range to attain the maximum percentage of austenite phase depending on the steel composition, and the temperature range at the composition is from 700° C. to 1300° C. Longer annealing time is more preferable because the percentage of austenite phase comes close to the one in equilibrium state determined by the steel composition and the temperature. Nevertheless, about 30 seconds or more of the annealing time is sufficient.

Large amount of C, N, and Cr in the steel often increases the amount of C and N in the austenite phase. With the same composition of steel, smaller percentage of austenite phase after annealing to form solid solution often enriches C and N more in the austenite phase. These tendencies should be considered.

If the steel is a hot-rolled sheet without undergoing the final annealing step, the finish temperature of the hot-rolling step is preferably controlled to a range from 700° C. to 1300° C. If the steel is a hot-rolled and annealed sheet, the annealing temperature of the hot-rolled sheet is preferably limited to a range from 700° C. to 1300° C. If the steel is a cold-rolled and annealed sheet, the final annealing temperature after the cold-rolling is preferably controlled to a range from 700° C. to 1300° C.

The manufacturing methods other than the above-given one may be a manufacturing method for ordinary austenitic stainless steels. Specific manufacturing methods are described below.

For example, the manufacturing method may be the ones given below. The steel, however, is not limited to those ones.

A steel ingot is prepared by smelting the steel in a converter, an electric furnace, and the like, followed by, if needed, secondary smelting by vacuum oxygen decarburization (VOD), argon oxygen decarburization (AOD), or the like. The ingoting may be done by vacuum melting or in an atmosphere controlling the nitrogen partial pressure in a range from 0 to 1 atm. The ingot may be formed into slabs having 100 to 300 mm in thickness by a known casting method (continuous casting, blooming, and the like). The slabs are then heated to 900° C. to 1500° C., and are hot-rolled (reverse rolling or unidirectional rolling) to become hot-rolled sheets having desired thickness of from 1.5 to 10 mm.

The hot-rolled sheets are subjected to annealing at temperatures ranging from 700° C. to 1300° C., at need, and then are treated by picking or the like for descaling to become the hot-rolled and annealed sheets.

Depending on the uses, the hot-rolled sheets or the hot-rolled and annealed sheets are treated by cold-rolling to form cold-rolled sheets having 0.1 to 8 mm in thickness. In that case, one or more cycles of annealing, pickling, and cold-rolling are repeated to obtain the desired thickness of the cold-rolled sheets. As described above, the cold-rolled sheets are treated by picking after the annealing at temperatures ranging from 700° C. to 1300° C., thus the cold-rolled and annealed sheets are obtained.

With any of the hot-rolled steel sheets, the hot-rolled and annealed sheets, and the cold-rolled and annealed sheets, the desired effect is attained by adopting the manufacturing conditions that the volume percentage of the austenite phase in the steel is adjusted to a range from 10 to 85% or that further the amount of (C+N) in the austenite phase are adjusted to a range from 0.16 to 2% by mass. The effect is attained in any surface-finished state (No. 2D, No. 2B, BA, buff-finish, and the like specified in JIS G4305 (2003)). Furthermore, the effect is attained not only on the above rolled sheets but also on wires, pipes, shape steels, and the like.

Example 1

Steels having various compositions given in Table 1 were ingoted by vacuum melting or in an atmosphere with 0 to 1 atm of nitrogen partial pressure to prepare the respective steel slabs. The slabs were heated to 1250° C., and were treated by hot-rolling (11 to 12 passes to hot-roll to 3 to 4 mm in thicknesses), annealing the hot-rolled sheets (1100° C. for 1 minute), and cold-rolling (cold-rolled at the Temperature from room temperature to 300° C.). After that, the sheets were treated by finish-annealing at the respective annealing temperatures given in Table 2, for 1 minute, thus obtained the respective cold-rolled and annealed sheets having 0.8 mm in thickness, while having different percentage of austenite phase and different amount of (C+N) in the austenite phase from each other.

Thus obtained cold-rolled and annealed sheets underwent the structure observation, composition analysis of austenite phase, tensile test, and determination of limited drawing ratio (LDR) applying the following-described methods.

<Structure Observation>

The cross sectional structure of each of the above cold-rolled and annealed sheets in the rolling direction was observed in a range of (total thickness×0.1 mm) or more using a light microscope. The area percentage of the austenite phase was adopted as the percentage of austenite phase. The determination procedure is the following. The cross section of a sample in the rolling direction was polished, then the section was etched by a red prussiate solution (potassium ferricyanide 30 g+potassium hydroxide 30 g+water 60 ml) or an aqua regia. The etched section was photographed in monochrome. The image analysis was given to the photograph to determine the percentage of white section (austenite phase and martensite phase) and of gray section (ferrite phase). The percentage of white section is adopted as the percentage of austenite phase. Although the white section may include martensite phase other than the austenite phase, the value determined by the method can be adopted as the percentage of austenite phase because the stainless steel contains only a small amount of martensite phase. The white section and the gray section may be inversed in some cases. In that case, however, the austenite phase can be differentiated from the ferrite phase based on the precipitation configuration of the austenite phase.

<Composition Analysis of Austenite Phase>

With the above sample polished on the section, the composition in the austenite phase was analyzed by EPMA. That is, since C and N tend to enrich themselves in the austenite phase, firstly the qualitative mapping of C or N was given on the whole sectional area to determine the austenite phase. Then, quantitative analysis of C, N, Si, Mn, Cr, Ni, Cu, and Mo was given at near-central section of the austenite phase while avoiding the irradiation of electron beam onto the ferrite phase. The range of determination was about 1 μmϕ, and the number of determination points was 3 for each sample, giving the average value thereof as the representative value. Using these observed values, the strain-induced martensite index (Md(γ)) defined by the formula (1) was derived.

$$Md(\gamma)=551-462(C(\gamma)+N(\gamma))-9.2Si(\gamma)-8.1Mn(\gamma)-13.7Cr(\gamma)-29Ni(\gamma)-29Cu(\gamma)-18.5Mo(\gamma) \quad (1)$$

where, C(γ), N(γ), Si(γ), Mn(γ), Cr(γ), Ni(γ), Cu(γ), and Mo(γ) are respectively C content (% by mass), N content (% by mass), Si content (% by mass), Mn content (% by mass), Mo content (% by mass), Ni content (% by mass), Cu content (% by mass), and Cr content (% by mass) in the austenite phase.

<Tensile Test>

Tensile test pieces of JIS 13-B were taken from a cold-rolled and annealed sheet in each direction of 0° (parallel to the rolling direction), 45°, and 90° to the rolling direction. Tensile test was given to these test pieces at room temperature in air, with 10 mm/min of tension speed. The tensile test determined the total elongation in each direction before breaking, and the average elongation (EI) was calculated using the following formula. The calculated EI was adopted as the total elongation for evaluation.

$$EI=\{EI(0°)+2EI(45°)+EI(90°)\}/4$$

<Limited Drawing Ratio (LDR)>

Circular test pieces having various diameters (blank diameters) were punched from the above cold-rolled and annealed sheet. The test piece was treated by cylindrical draw-forming under the condition of 35 mm in punch diameter and 1 ton of sheet-pressing force. The maximum blank diameter which allowed drawing without break was divided by the punch diameter to obtain the limited drawing ratio (LDR) for evaluating the deep drawability. The punching diameter of test piece applied to cylindrical draw-forming was varied to secure of 0.1 interval of the drawing ratio.

The result of the above test is given in Table 2. FIG. 1 shows the effect of the amount of (C+N) in the austenite phase and the percentage of austenite phase on the total elongation, which effect is derived from Table 2. FIG. 1 shows that, even the same percentage of austenite phase, the steels which having 0.16 to 2% by mass of the amount of (C+N) in the austenite phase gives high elongation and gives excellent ductility compared with those of the steels containing less than 0.16% by mass of the amount of (C+N) in the austenite phase.

Figure 2:
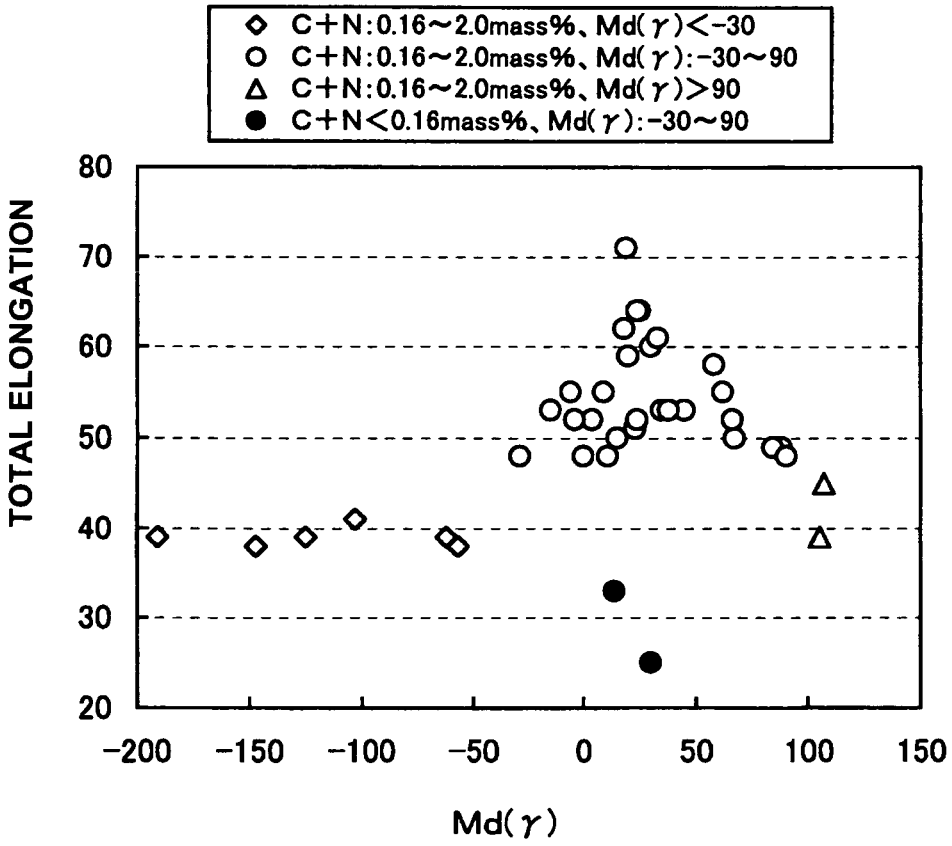
FIG. 2 is a graph showing the relation between the total elongation and the strain-induced martensite index (Md(γ)) of austenite phase of the austenitic-ferritic stainless steels.

FIG. 2 shows the effect of the strain-induced martensite phase index (Md(γ)) on the elongation, based also on the result given in Table 2. FIG. 2 shows that even the steels of which have 0.16 to 2% by mass of the amount of (C+N) in the austenite phase further improve the characteristic by controlling the Md(γ) value in an appropriate range, and that, particularly when the Md(γ) value is controlled to a range from −30 to 90, significantly superior ductile characteristic of 48% or more of total elongation (at 0.8 mm in sheet thickness) is attained.

Figure 3:
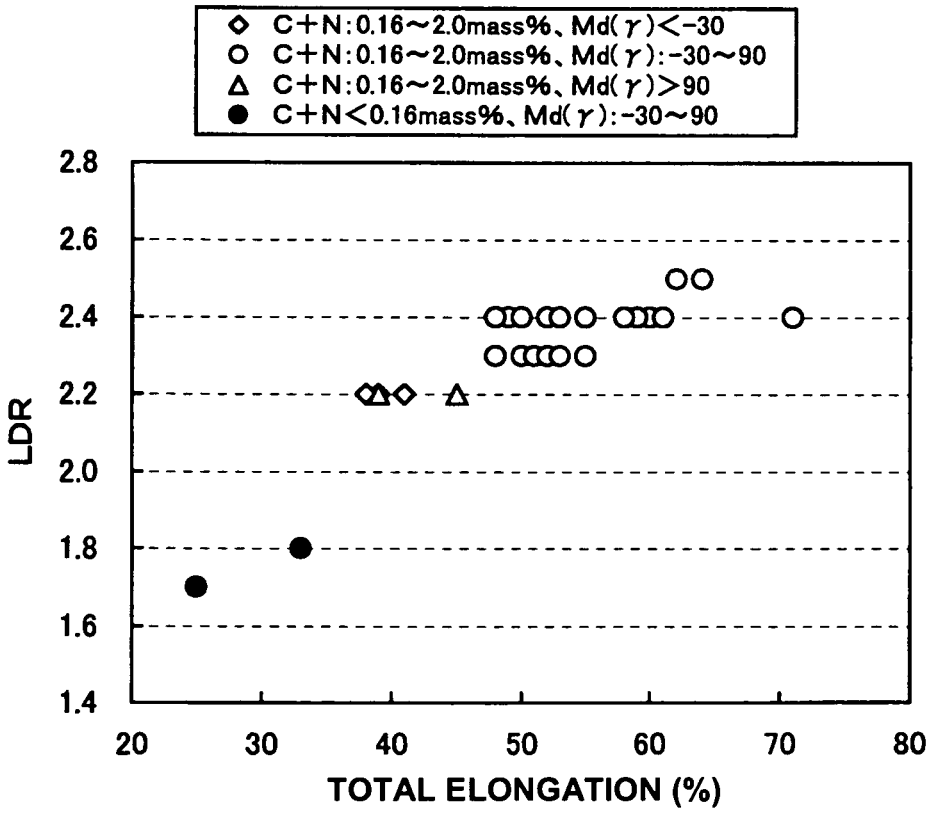
FIG. 3 is a graph showing the relation between the total elongation and the limited drawing ratio (LDR) of the austenitic-ferritic stainless steels.

FIG. 3 shows the relation between the total elongation and the limited drawing ratio (LDR). FIG. 3 shows that the austenitic-ferritic stainless steels have very large LDR compared with that of the comparative steels, and have not only high ductility but also excellent deep drawability.

Steels No. 13 and No. 18 in Table 1 were formed into the respective hot-rolled sheets (1.7 mm in thickness, 100° C. of finish temperature) and the respective hot-rolled and annealed sheets (annealed at 1050° C. for 1 minute). With the same method applied to above cold-rolled and annealed sheets, they were analyzed to determine the percentage of austenite phase, the amount of (C+N) in the austenite phase, the tensile strength, and the limited drawing ratio.

The hot-rolled sheets of No. 13 and No. 18 showed the percentage of austenite phase of 59% and 57%, the amount of (C+N) in the austenite phase of 0.40% and 0.43% by mass, the total elongation of 58% and 60%, and the limited drawing ratio of 2.3 and 2.4, respectively. The hot-rolled and annealed sheets of No. 13 and No. 18 showed the percentage of austenite phase of 60% and 59%, the amount of (C+N) in the austenite phase of 0.39% and 0.42% by mass, the total elongation of 60% and 61%, and the limited drawing ratio of 2.4 and 2.4, respectively. The analysis showed similar performance for both the hot-rolled sheets and the hot-rolled and annealed sheets with that of cold-rolled and annealed sheets.

Example 2

Steels having various compositions given in Table 3 were ingoted by vacuum melting or in an atmosphere with controlled nitrogen partial pressures to prepare the respective steel slabs. The slabs were heated to 1250° C., and were treated by hot-rolling (11 to 12 passes to hot-roll to 3 to 4 mm in thicknesses), annealing the hot-rolled sheets (1100° C. for 1 minute), and cold-rolling (cold-rolled at the temperature from room temperature to 300° C.). After that, the sheets were treated by finish-annealing at temperatures ranging from 950° C. to 1300° C. given in Table 4, for 30 to 600 seconds under an atmosphere of controlled nitrogen partial pressure, thus obtained the respective cold-rolled and annealed sheets having 1.25 mm in thickness, while having different percentages of austenite phase and different amounts of (C+N) in the austenite phase from each other. Thus obtained cold-rolled and annealed sheets underwent the structure observation, the analysis of C and N in the austenite phase, and the determination of limited drawing ratio (LDR) applying the following-described methods.

The structure observation, the analysis of C and N in the austenite phase, and the LDR were conducted by the same procedure applied to Example 1.

Figure 4:
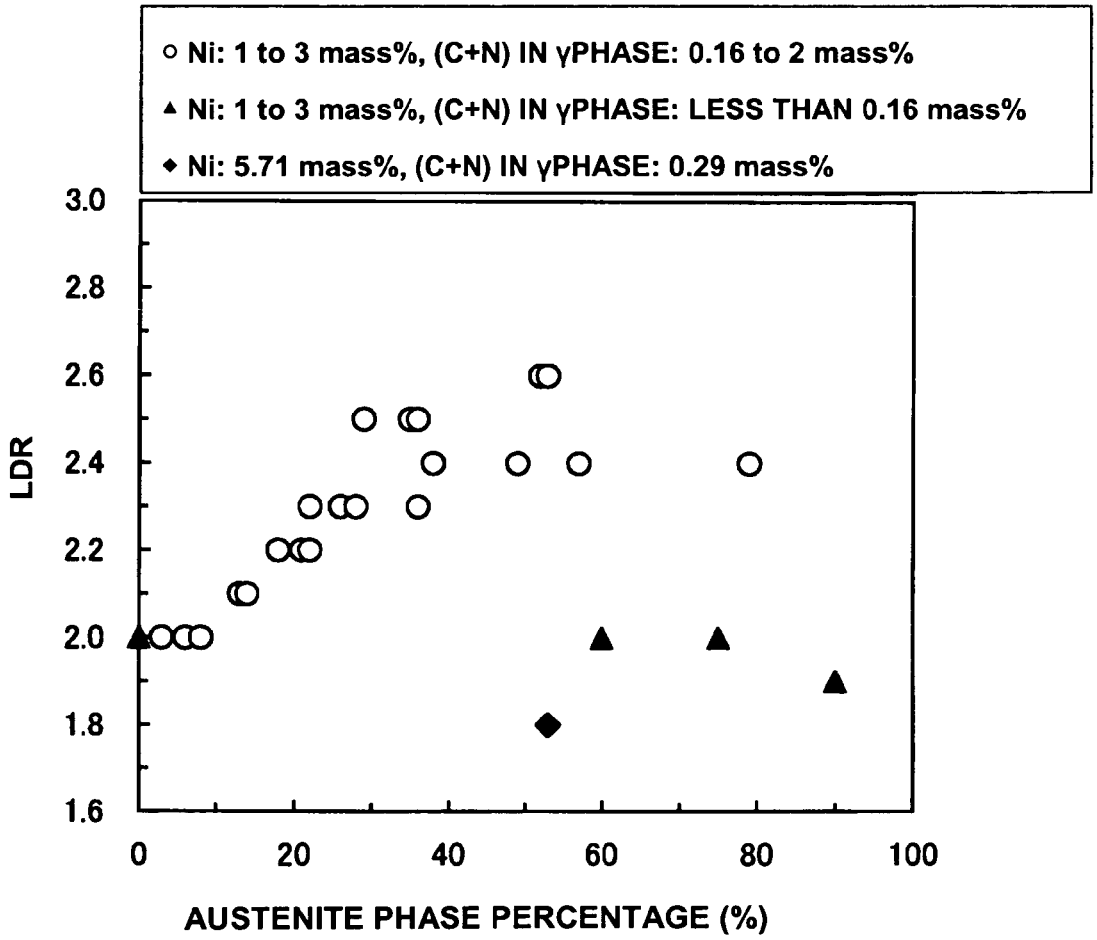
FIG. 4 is a graph showing the relation between the Ni content, the percentage of austenite phase, the amount of (C+N) in the austenite phase, and the limited drawing ratio (LDR) of the steel sheets.

The analytical results are given in Table 4. In addition, FIG. 4 shows the effect of the Ni content in the steel, the percentage of austenite phase, and the amount of (C+N) in the austenite phase on LDR. The result shows that the austenitic-ferritic stainless steel sheets satisfying selected conditions or containing 1 to 3% by mass of Ni, 10 to 85% of austenite phase, and 0.16 to 2% of (C+N) amount in the austenite phase, gave as high as 2.1 or more of LDR, showing excellent deep drawability. To the contrary, the austenitic-ferritic stainless sheets containing the austenite phase outside the range of 10 to 85% and/or containing the amount of (C+N) in the austenite less than 0.16% by mass gave LDR as low as below 2.1, showing poor deep drawability. The austenitic-ferritic stainless steel sheets containing more than 3% by mass of Ni, even with the percentage of austenite phase and the amount of (C+N) in the austenite phase within the selected range, showed LDR as low as smaller than 2.1, giving poor deep drawability.

Steels No. 3 and No. 5 in Table 3 were also hot-rolled to the respective hot-rolled sheets (1.7 mm in thickness, 1000° C. of finish temperature) and were annealed at 1050° C. for 1 minute to prepare the respective hot-rolled and annealed sheets. They were analyzed to determine the percentage of austenite phase, the amount of (C+N) in the austenite phase, and the limited drawing ratio, using the same procedures applied to the cold-rolled and annealed sheets.

The hot-rolled sheets of No. 3 and No. 5 showed the percentage of austenite phase of 81% and 53%, the amount of (C+N) in the austenite phase of 0.16% and 0.54% by mass, and the limited drawing ratio of 2.4 and 2.5, respectively. The hot-rolled and annealed sheets of No. 3 and No. 5 showed the percentage of austenite phase of 79% and 52%, the amount of (C+N) in the austenite phase of 0.16% and 0.53% by mass, and the limited drawing ratio of 2.4 and 2.6, respectively. The analysis showed similar performance for both the hot-rolled sheets and the hot-rolled and annealed sheets with that of cold-rolled and annealed sheets.

Depending on the desired uses, we provide steel sheets emphasizing the improvement in the following-described (2) punch stretchability and crevice corrosion resistance, (3) corrosion resistance at welded part, or (4) intergranular corrosion resistance, as well as the above-described (1) high formability with excellent ductility and deep drawability. To do this, the following-specification is applied. The aspects described below are also within the selected range.

(2) Austenitic-Ferritic Stainless Steel Having Excellent Punch Stretchability and Crevice Corrosion Resistance Compared with the austenitic stainless steels and the ferritic stainless steels containing 15 to 35% by mass of Cr, or similar Cr content with that in our steels, superior crevice corrosion resistance is provided by the addition of 1.2% by mass or less Si, 2% by mass or less Mn, and 1% by mass or less Ni to those steels having the compositions described above (1): a steel containing 0.2% by mass or less C, 4% by mass or less Si, 12% by mass or less Mn, 0.1% by mass or less P, 0.03% by mass or less S, 15 to 35% by mass Cr, 3% by mass or less Ni, 0.05 to 0.6% by mass N, and balance of Fe and inevitable impurities; a steel further containing one or more of 4% by mass or less Mo and 4% by mass or less Cu; a steel further containing 0.5% by mass or less V; a steel further containing 0.1% by mass or less Al; or a steel further containing one or more of 0.01% by mass or less B, 0.01% by mass or less Ca, 0.01% by mass or less Mg, 0.1% by mass or less REM, and 0.1% by mass or less Ti, (without specifying the amount of (C+N) in the austenite phase). A presumable cause of the superior crevice corrosion resistance of the austenitic-ferritic stainless steels is that the enrichment of Cr in the ferrite phase and of N in the austenite phase strengthened the passive film of each phase.

The reasons of specification of ingredients are described below.

Si: 1.2% by mass or less

Silicon is an effective element as deoxidizer. To attain the effect, 0.01% by mass or more of the Si content is preferred. If, however, the Si content exceeds 1.2% by mass, the hot-workability deteriorates, thus the Si content is preferably limited to 1.2% by mass or less, and more preferably 1.0% by mass or less. If the deterioration in corrosion resistance caused by sensitization is emphasized, the Si content is preferably limited to 0.4% by mass or less.

Mn: 2% by mass or less

Figure 5:
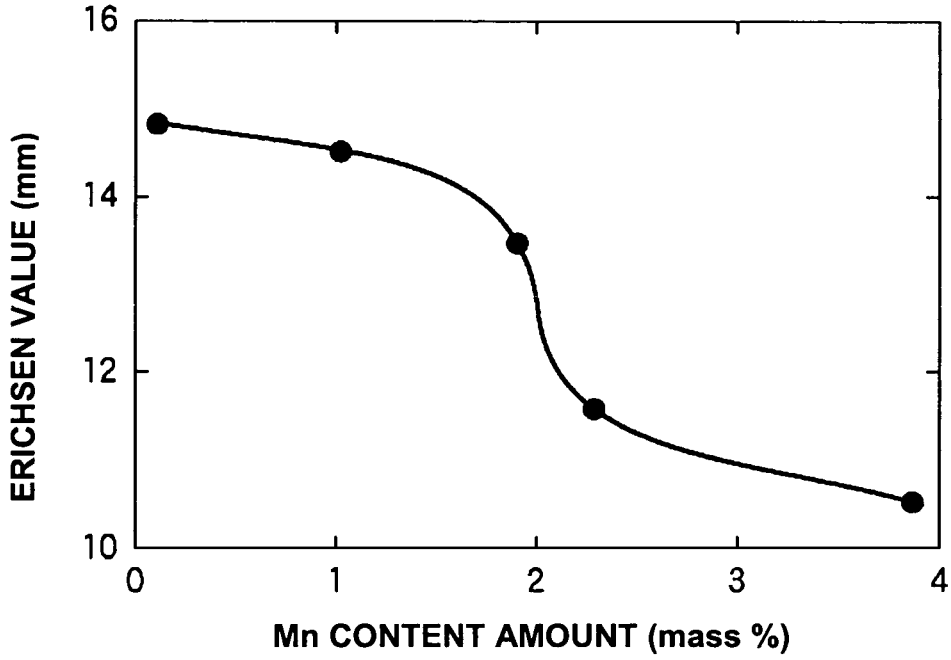
FIG. 5 is a graph showing the effect of Mn content on the punch stretchability of austenitic-ferritic stainless steel sheets which contain 1% or less Ni and 40 to 50% by volume of austenite phase.

The Mn content is particularly important to attain excellent punch stretchability and crevice corrosion resistance. To attain the effect, 0.04% by mass or more of the Mn content is preferred. FIG. 5 is a graph showing the effect of Mn content on the punch stretchability (Erichsen value) in the austenitic-ferritic stainless steels containing 1% by mass or less Ni and 40 to 50% by volume of austenite phase. As seen in the figure, Mn significantly affects the punch stretchability, and 2% by mass or less of the Mn content significantly improves the formability. The reason of the improvement is not fully analyzed, and the phenomenon does not affect our concepts (ranges). A cause of the phenomenon is that small Mn content significantly decreases the Mn concentration in the ferrite phase, thereby significantly improving the ductility of ferrite phase.

Figure 6:
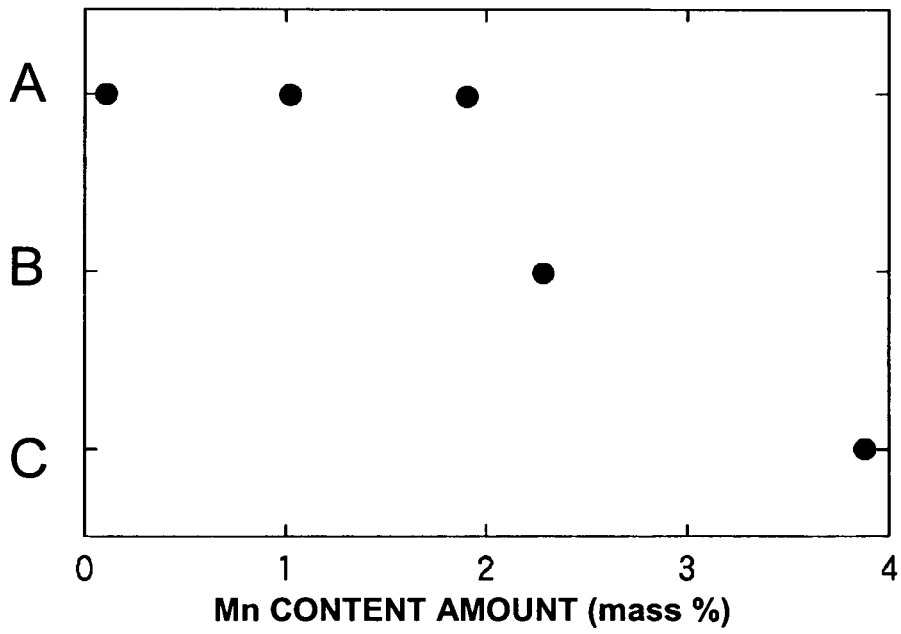
FIG. 6 is a graph showing the effect of Mn content on the outdoor exposure test of austenitic-ferritic stainless steel sheets which contain 1% or less Ni and 40 to 50% by volume of austenite phase.

FIG. 6 is a graph showing the effect of the Mn content on the result of outdoor exposure test of austenitic-ferritic stainless steel sheets containing 1% by mass or less Ni and 40 to 50% by volume of austenite phase. The judgment A is "no corrosion occurred", the judgment B is "crevice corrosion appeared", and the judgment C is "corrosion appeared on both crevice zone and mother material part". When the Mn content is 2% by mass or less, favorable crevice corrosion resistance is attained. Although the cause of the phenomenon is not fully analyzed and does not affect our concepts (ranges), a reason is that the small Mn content induces the decrease in the amount of inclusions, such as MnS, that inversely affect the crevice corrosion resistance. Based on the findings given in FIG. 5 and FIG. 6, the Mn content is limited to 2% by mass or less, and preferably 1.5% by mass or less, to attain satisfactory characteristics relating to the punch stretchability and the crevice corrosion resistance.

Ni: 1% by mass or less

Nickel is an element to enhance the formation of austenite phase. To attain the effect, 0.01% by mass or more of the Ni content is preferred. However, when the Ni content becomes excessive, the excellent punch stretchability cannot be attained. For example, SUS329 series austenitic-ferritic stainless steels contain austenite phase by about 50%. If, however, the Ni content exceeds 1% by mass, the punch stretchability significantly deteriorates. In addition, Ni is an expensive alloying element, and the Ni content is required to minimize to a necessary limit to form the austenitic-ferritic structure from the point of economy and resource-saving. From the viewpoint, the Ni content is limited to 1% by mass or less, and preferably 0.9% by mass or less. If, however, the Ni content is 0.10% by mass or less, the toughness of steel deteriorates in any of the mother material part and the welded part. Therefore, the Ni content is most preferably limited to more then 0.10% and not more than 0.9% by mass.

Our steels have the above-compositions and the austenitic-ferritic stainless steels having the metal structure containing 10 to 85% by volume of austenite phase.

Figure 7:
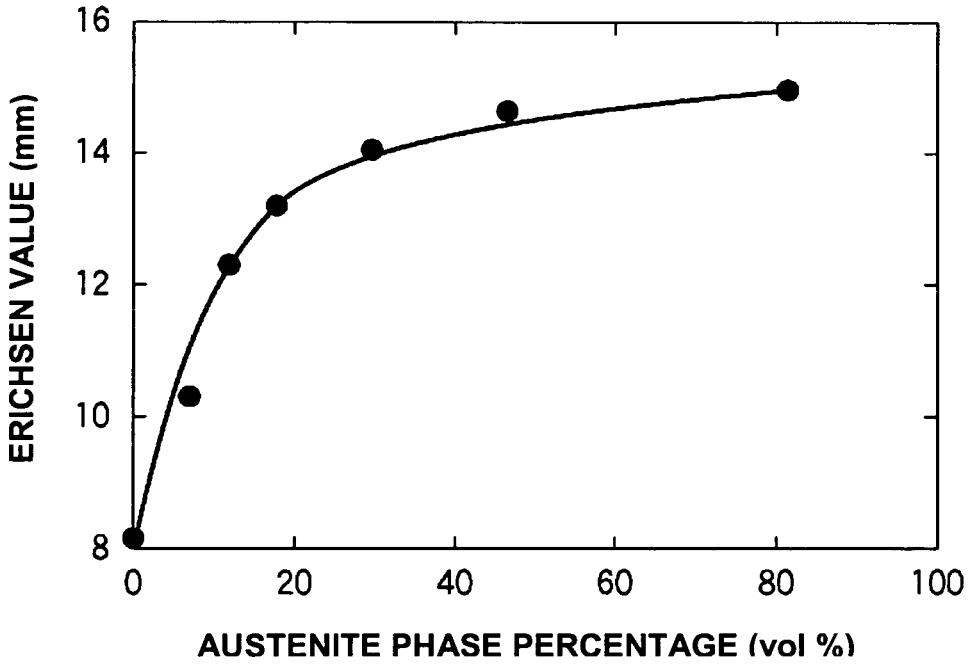
FIG. 7 is a graph showing the relation between the percentage of austenite phase and the punch stretchability (Erichsen value) of austenitic-ferritic stainless steel sheets which contain 2% or less Mn and 1% or less Ni.

FIG. 7 is a graph showing the relation between the percentage of austenite phase and the punch stretchability (Erichsen value) of austenitic-ferritic stainless steel sheets which contain 2% or less Mn and 1% or less Ni, by mass. As seen in the figure, the punch stretchability improves with the increase in the percentage of austenite phase, giving specific improvement in the punch stretchability at 10% by volume or more of the percentage of austenite phase, and particularly at 15% by volume thereof. However, the Ni content is limited to 1% by mass or less because of economy, and in that case therefore, the percentage of austenite phase becomes difficult to exceed 85% by volume. Consequently, the present invention limits the percentage of austenite phase to a range from 10 to 85% by volume, and preferably from 15 to 85% by volume.

The austenitic-ferritic stainless steels having the above basic composition and having 10 to 85% by volume of austenite phase in the metal structure are relatively low cost and excellent in punch stretchability and crevice corrosion resistance while saving the Ni resource.

To further assure the ductility and the deep drawability, however, the austenitic-ferritic stainless steels are preferably limited to have the amount of (C+N) in the austenite phase of the steel structure in a range from 0.16 to 2% by mass. If the amount of (C+N) in the austenite phase of the steel structure is less than 0.16% by mass, satisfactory ductility and deep drawability cannot be obtained. On the other hand, the amount of (C+N) more than 2% by mass is difficult to attain. Preferably, the amount of (C+N) is limited to a range from 0.2 to 2% by mass.

The amount of C and N in the austenite phase can be controlled by adjusting the steel composition and the annealing conditions (temperature and time). The relation between the steel structure, the annealing condition, and the amount of C and N in the austenite phase cannot be generally defined. However, appropriate amount of C and N can be adjusted based on the empirical knowledge such that large amount of Cr, C, and N in the steel structure often leads to increase in the amount of C and N in the austenite phase, and that, with the same composition of steel, smaller percentage of austenite phase determined by the annealing condition often increases more the amount of C and N in the austenite phase. The determination of the amount of C and N in the austenite phase can be done by, for example, EPMA.

Example 3

Steels having various compositions given in Table 5 were ingoted by vacuum melting or in an atmosphere with controlled nitrogen partial pressures up to 0.9 atm (882 hPa) to prepare the respective steel slabs (or ingots or casts). The slabs were heated to 1250° C., and were treated by hot-rolling (11 to 12 passes to hot-roll to 3 to 4 mm in thicknesses), annealing the hot-rolled sheets (1100° C. for 1 minute), and cold-rolling (cold-rolled at the temperature from room temperature to 300° C.). After that, the sheets were treated by finish-annealing at temperatures ranging from 900° C. to 1300° C., thus obtained the respective cold-rolled and annealed sheets having 1.25 mm in thickness. The obtained cold-rolled and annealed sheets underwent the determination of percentage of austenite phase, punch stretchability, and crevice corrosion resistance.

Figure 8:
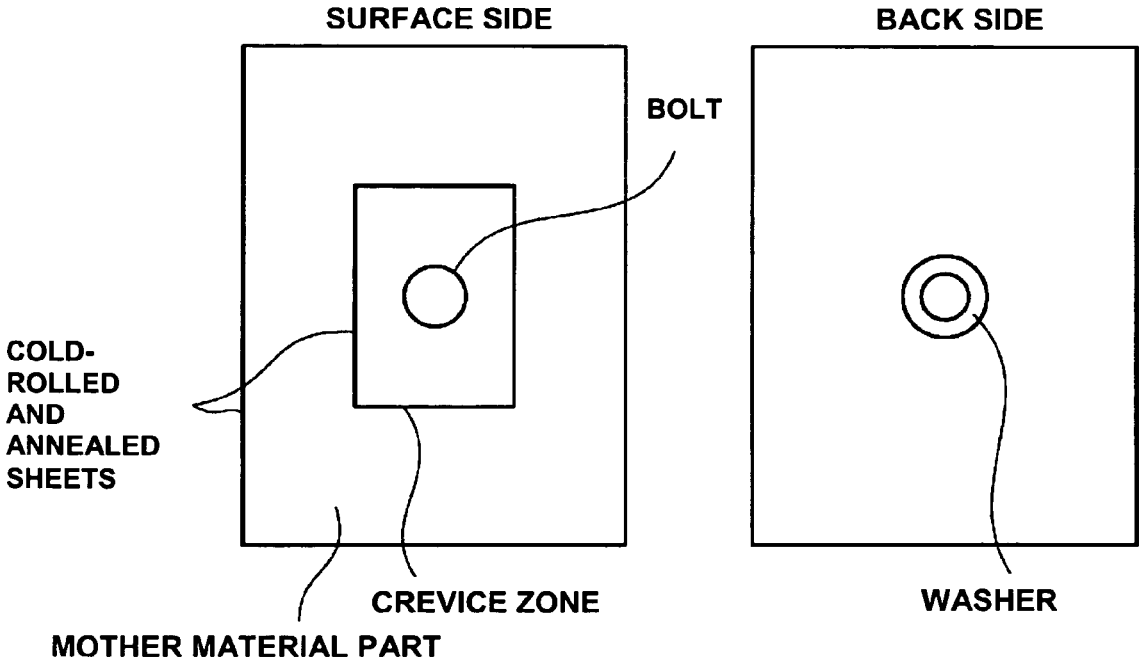
FIG. 8 illustrates a test piece for crevice corrosion test.

Determination of the percentage of austenite phase was conducted by similar procedure with that for Example 1. The punch stretchability was determined by Erichsen test, and the punch indenting depth at the occurrence of crack was adopted as the Erichsen value. The test piece was square plate (80 mm×80 mm) lubricated by a graphite grease. The test was given with the punch diameter of 20 mm and the blank holding force of 15.7 kN. Other testing conditions conformed to JIS Z2247 "Erichsen test". Regarding the crevice corrosion test, a cold-rolled and annealed sheet having the size of 8 cm in width and 12 cm in length, descaled on the surface thereof, was attached with a cold-rolled and annealed sheet having the same base material as above and having the size of 3 cm in width and 4.5 cm in length, (small sheet), descaled on the surface thereof, as illustrated in FIG. 8. These sheets were firmly fixed together using a set of bolt and washer, both of which were made by Teflon (trade name). Thus assembled test piece was subjected to outdoor exposure test for 7 months at a place of about 0.7 km distant from sea shore. After the exposure, the test piece was disassembled to visually observe the presence/absence of corrosion at crevice zone and at mother material part.

The test result is given in Table 6A. As seen in Table 5 and Table 6A, the austenitic-ferritic stainless steels that satisfy the conditions of the present invention had 12 mm or more of Erichsen value to give high punch stretchability, and showed no crevice corrosion in the exposure test. In FIG. 6A, the evaluation of crevice corrosion resistance was given as "o" for no corrosion occurrence, and "X" for corrosion occurrence.

Table 6B gives the evaluation of punch stretchability and crevice corrosion resistance for the steel Nos. 1 to 4 in Table 1 and Table 2 in Example 1, applying the same procedure with that for above examples. These tables show that the obtained sheets have excellent punch stretchability and crevice corrosion resistance, as well as excellent formability given in Table 2.

Also for the hot-rolled sheets which were prepared by hot-rolling the steel No. 3 and No. 4 in Table 5 to 1.7 mm in thickness, (at 1000° C. of finish temperature), and for the hot-rolled and annealed sheets which were prepared by further annealing the hot-rolled sheets at 1050° C. for 1 minute, the same procedure as that for the cold-rolled and annealed sheets was applied to determine the percentage of austenite phase, the punch stretchability, and the crevice corrosion resistance. For the hot-rolled sheets, the percentage of austenite phase was 48% and 45%, the Erichsen value was 14.5 mm and 14.0 mm, respectively to the steel No. 3 and the steel No. 4. For the hot-rolled and annealed sheets, the percentage of austenite phase was 47% and 44%, and the Erichsen value was 14.6 mm and 14.2 mm, respectively to the steel No. 3 and the steel No. 4. There was observed no corrosion at both the mother material part and the crevice zone for both the hot-rolled sheets and the hot-rolled and annealed sheets. As a result, both the hot-rolled sheets and the hot-rolled and annealed sheets showed the performance similar with that of the cold-rolled and annealed sheets.

(3) Austenitic-Ferritic Stainless Steel Having Excellent Formability and Further Having Excellent Corrosion Resistance at Welded Part The steels are austenitic-ferritic stainless steels which have the compositions described above (1), (a steel containing 0.2% by mass or less C, 4% by mass or less Si, 12% by mass or less Mn, 0.1% by mass or less P, 0.03% by mass or less S, 15 to 35% by mass Cr, 3% by mass or less Ni, 0.05 to 0.6% by mass N, and balance of Fe and inevitable impurities; a steel further containing one or more of 4% by mass or less Mo and 4% by mass or less Cu; a steel further containing 0.5% by mass or less V; a steel further containing 0.1% by mass or less Al; or a steel further containing one or more of 0.01% by mass or less B, 0.01% by mass or less Ca, 0.01% by mass or less Mg, 0.1% by mass or less REM, and 0.1% by mass or less Ti, while these austenitic-ferritic stainless steels particularly have 1.2% by mass or less Si, 4 to 12% by mass Mn, and 1% by mass or less Ni, and have 10 to 85% by volume of the austenite phase in the metal structure.

The reasons of specification of ingredients are described below.

Si: 1.2% by mass or less

Silicon is an effective element as deoxidizer. To attain the effect, 0.01% by mass or more of the Si content is preferred. If, however, the Si content exceeds 1.2% by mass, the hot-workability deteriorates, thus the Si content is preferably limited to 1.2% by mass or less, and more preferably 1.0% by mass or less. If the deterioration in corrosion resistance caused by sensitization is required to be further suppressed, the Si content is preferably limited to 0.4% by mass or less.

Mn: 4% to 12% by mass

Figure 9:
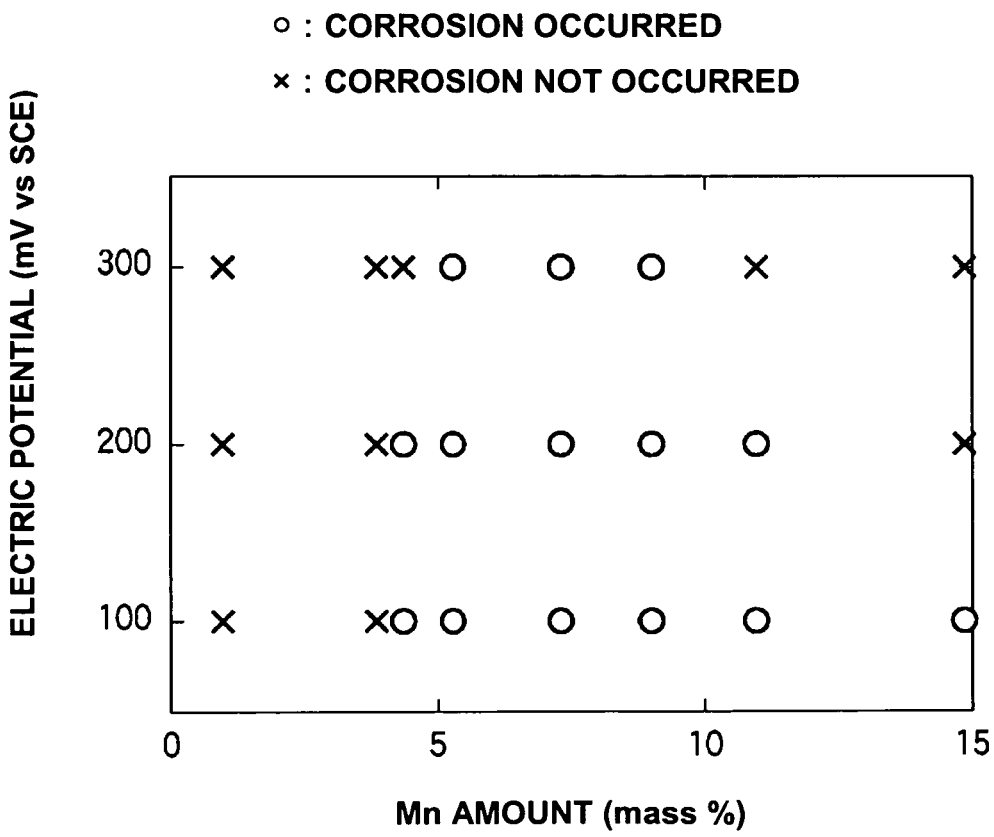
FIG. 9 is a graph showing the relation between the occurrence of corrosion and the Mn content of welded test pieces containing welded part, heat affecting zone, and mother material part, held in a 0.035% by mass of sodium chloride aqueous solution at 100 to 300 mV vs SCE potential for 30 minutes.

Manganese is a particularly important element to attain excellent corrosion resistance at welded part. FIG. 9 is a graph showing the relation between the occurrence of corrosion and the Mn content of welded test pieces containing welded part, heat affecting zone, and mother material part, held in a 0.035% by mass of sodium chloride aqueous solution at potential of 100 to 300 mV vs SCE for 30 minutes. For the presence/absence of corrosion, the current value of 1 mA or more was judged as "corrosion occurred", and the current value lower than 1 mA was judged as "corrosion not occurred".

As seen in FIG. 9, the Mn content at or above 4% by mass definitely and significantly improves the corrosion resistance of the welded material. We believe that the cause of the improvement in the corrosion resistance is as follows. When the Mn content increases to 4% by mass or more, the precipitation temperature of chromium nitride decreases, which suppresses the formation of chromium nitride and further the generation of chromium-depletion zone at the welded part and the heat-affecting zone near the welded part. As seen in FIG. 9, however, when the Mn content exceeds 12% by mass, excellent corrosion resistance cannot be attained. The cause is presumably that the Mn content of higher than 12% by mass induces the formation of many corrosion origins such as MnS in the mother material part. Therefore, the Mn content is limited to a range from 4 to 12% by mass, preferably 5.2 to 10% by mass, and more preferably less than 6.8% by mass.

Ni: 1% by mass or less

Nickel is an element to enhance the formation of austenite, and is useful to form the austenitic-ferritic structure. To attain the effect, 0.01% by mass or more of the Ni content is preferred. Nickel is, however, an expensive element, and has to be minimized in view of resource conservation. From that point of view, the Ni content is limited to 1% by mass or less, and preferably 0.9% by mass or less. If, however, the Ni content is 0.10% by mass or less, the toughness of the mother material and the welded part deteriorates. Consequently, to improve the toughness including the welded part, the Ni is preferably contained by the amount more than 0.10% by mass, (refer to Example 6).

Figure 10:
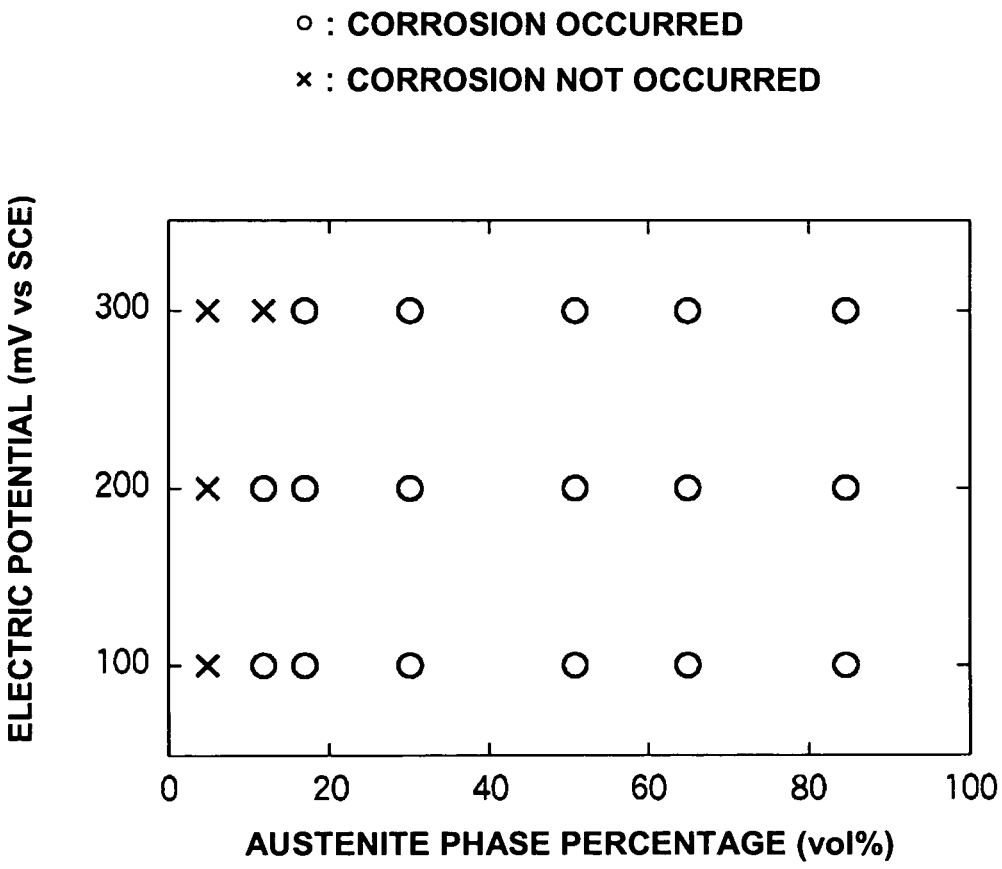
FIG. 10 is a graph showing the effect of the percentage of austenite phase on the corrosion of welded test piece containing mother material part.

FIG. 10 is a graph showing the effect of the percentage of austenite phase on the corrosion of welded material containing mother material part. The procedure to determine the corrosion resistance is the same with that of FIG. 9. As seen in FIG. 10, when the percentage of austenite phase becomes 10% by volume or more, the corrosion resistance at the welded part significantly improves.

Although the cause of the phenomenon does not affect the interpretation of the technical range, we believe that the cause thereof is as follows. Our general understanding is that the austenitic-ferritic stainless steels having small Ni content and large N content show high diffusion rate of Cr and N during cooling step after welding, which induces precipitation of chromium nitride at grain boundaries containing ferrite phase, thereby likely generating the chromium-depletion zone. However, since the austenitic-ferritic stainless steels having austenite phase by 10% by volume or more, particularly 15% by volume or more, as in the case of the present invention, have high performance to form austenite phase, even when Cr decreases at the grain boundaries containing ferrite phase, the portion transforms to the austenite phase to increase the solubility of chromium nitride, thus resulting in the decrease of the chromium-depletion zone.

If, however, the percentage of austenite phase exceeds 85% by volume, the sensitization of stress corrosion cracking significantly increases. Therefore, we limits the percentage of austenite phase to a range from 10 to 85% by volume, and preferably from 15 to 85% by volume.

To further assure the ductility and the deep drawability, the austenitic-ferritic stainless steels are preferably limited to have the amount of (C+N) in the austenite phase of the steel structure in a range from 0.16 to 2% by mass. If the amount of (C+N) in the austenite phase of the steel structure is less than 0.16% by mass, satisfactory ductility and deep drawability cannot be obtained. On the other hand, the amount of (C+N) more than 2% by mass is difficult to attain. Preferably, the amount of (C+N) is limited to a range from 0.2 to 2% by mass.

The amount of C and N in the austenite phase can be controlled by adjusting the steel composition and the annealing conditions (temperature and time). The relation between the steel structure, the annealing condition, and the amount of (C+N) in the austenite phase cannot generally be defined. However, appropriate amount of C and N can be adjusted based on the empirical knowledge such that large amount of Cr, C, and N in the steel structure often leads to increase the amount of C and N in the austenite phase, and that, with the same composition of steel, smaller percentage of austenite phase determined by the annealing condition often increases with the amount of C and N in the austenite phase. The determination of the amount of C and N in the austenite phase can be done by, for example, EPMA.

Example 4

Steels having various compositions given in Table 7 and Table 8 were ingoted by vacuum melting or in an atmosphere with controlled nitrogen partial pressures up to 0.9 atm (882 hPa) to prepare the respective steel slabs (or ingots or casts). The slabs were heated to 1250° C., and were treated by hot-rolling (10 to 11 passes to hot-roll to 4 to 6 mm in thickness), annealing the hot-rolled sheets (1100° C. for 1 minute), and cold-rolling (cold-rolled at the temperature from room temperature to 300° C.). After that, the sheets were treated by finish-annealing at temperatures ranging from 900° C. to 1300° C., thus obtained the respective cold-rolled and annealed sheets having 2.25 mm in thickness. The obtained cold-rolled and annealed sheets underwent the determination of percentage of austenite phase. Furthermore, with a TIG welding machine, a weld bead having about 5 mm in width was formed on each of the sheets under the condition of 900 W of input power and 30 cm/min of welding speed. The structure observation (the determination of the percentage of austenite phase) was given in a similar manner with that of Example 1.

The corrosion resistance test at the welded part was given on a square test piece having a size of 25 mm sides (containing the weld bead, the heat-affecting zone, and the mother material part) after descaling the surface thereof by grinding, by dipping the test piece in a 0.035% by mass of sodium chloride aqueous solution at 100, 200, and 300 mV vs SCE potential for 30 minutes. The test piece which generated 1 mA or higher current was evaluated as "corrosion occurred", and the test piece which did not generate 1 mA or higher current was evaluated as "corrosion not occurred". The test result is given in Table 9A. In Table 9A, the mark "○" represents "corrosion did not occurred", and the mark "X" represents "corrosion occurred". The welded material of the steel of the present invention did not generate corrosion up to 200 mV vs SCE potential, which shows the excellence in the corrosion resistance at the welded part.

Table 9B shows the evaluation of corrosion resistance at the welded part for the steel Nos. 12 to 29 of the steel sheets in Table 1 and Table 2 of Example 1, applying similar procedure as that for above examples. The evaluation shows that the obtained steel sheets have excellent corrosion resistance at welded part, as well as the excellent formability given in Table 2.

With the hot-rolled sheets rolled to 2.25 mm (at 1000° C. of finish temperature) using the steel No. 15, No. 16, and No. 17 in Table 8, or also with the hot-rolled and annealed sheets which were further annealed at 1050° C. for 1 minute, the same procedure as that applied to the above cold-rolled and annealed sheets was given to determine the percentage of austenite phase and to conduct the corrosion resistance test at the welded part. The obtained percentage of austenite phase in the hot-rolled sheets was 20%, 31%, and 52%, and that in the hot-rolled and annealed sheets was 18%, 30%, and 51%, respectively to the steel No. 15, No. 16, and No. 17. No corrosion was observed at the welded part on both the hot-rolled sheets and the hot-rolled and annealed sheets, giving performance equivalent to that of the cold-rolled and annealed sheets.

Example 5

Similar with Example 4, steels having various compositions given in Table 10 were ingoted to prepare the respective steel slabs (or ingots or casts). The slabs were heated to 1250° C., and were treated by hot-rolling (10 to 11 passes to hot-roll to 4 to 6 mm in thickness), annealing the hot-rolled sheets (1100° C. for 1 minute), and cold-rolling (cold-rolled at the temperature from room temperature to 300° C.). After that, the sheets were treated by finish-annealing at a temperature of 1050° C. to obtain the respective cold-rolled and annealed sheets having 2.25 mm in thickness. The obtained cold-rolled and annealed sheets underwent the determination of percentage of austenite phase. The determination of percentage of austenite phase was done by the procedure applied to Example 1.

With a TIG welding machine, a weld bead having about 5 mm in width was formed on each of the prepared cold-rolled sheets, lateral to the rolling direction thereof, under the condition of 900 W of input power and 30 cm/min of welding speed, thus preparing test pieces having the size of 10 mm in width and 75 mm in length, cut from the mother material part and from the welded part, respectively, in parallel to the rolling direction. Thus prepared test piece was bent to form a U-bend test piece having a bending radius of 10 mm. The test piece cut from the welded part was prepared so as the bottom of the U-bend test piece to have the welded part. The prepared U-bend test pieces were dipped in an aqueous solution of 42% by mass of magnesium chloride (at 80° C.). At every 24 hours of interval, visual observation was given on the test piece to check the occurrence of crack. The result is given in Table 11.

As shown in Table 11, the C content below 0.1% significantly improves the resistance to stress corrosion cracking for both the mother material part and the welded part.

Example 6

Similar with Example 4, steels having various compositions given in Table 12 were ingoted to prepare the respective steel slabs (or ingots or casts). The slabs were heated to 1250° C., and were treated by hot-rolling (10 to 11 passes to hot-roll to 4 to 6 mm in thickness), annealing the hot-rolled sheets (1100° C. for 1 minute), and cold-rolling (cold-rolled at the temperature from room temperature to 300° C.). After that, the sheets were treated by finish-annealing at a temperature of 1050° C. to obtain the respective cold-rolled and annealed sheets having 2.25 mm in thickness. The obtained cold-rolled and annealed sheets underwent the determination of percentage of austenite phase. The observation of structure (the determination of percentage of austenite phase) was given by the procedure applied to Example 1.

With a TIG welding machine, a weld bead having about 5 mm in width was formed on each of thus prepared cold-rolled sheets, lateral to the rolling direction thereof, under the condition of 900 W of input power and 30 cm/min of welding speed. From each of the cold-rolled sheets with weld bead, a Charpy impact test piece was cut so as the 2 mm V-notch to come lateral to the rolling direction. An impact test was given to the test piece at 0° C. The result is given in Table 13. As shown in Table 13, the Ni content of 0.1% or more significantly improves the impact absorbed energy for both the mother material part and the welded part.

(4) Austenitic-Ferritic Stainless Steel Having Excellent Intergranular Corrosion Resistance Selected steels have the compositions described above (1), (a steel containing 0.2% by mass or less C, 4% by mass or less Si, 12% by mass or less Mn, 0.1% by mass or less P, 0.03% by mass or less S, 15 to 35% by mass Cr, 3% by mass or less Ni, 0.05 to 0.6% by mass N, and balance of Fe and inevitable impurities; a steel further containing one or more of 4% by mass or less Mo and 4% by mass or less Cu; a steel further containing 0.5% by mass or less V; a steel further containing 0.1% by mass or less Al; or a steel further containing one or more of 0.01% by mass or less B, 0.01% by mass or less Ca, 0.01% by mass or less Mg, 0.1% by mass or less REM, and 0.1% by mass or less Ti, (without specifying the amount of (C+N) in the austenite phase)), while these steel sheets have 0.4% by mass or less Si, 2 to 4% by mass Mn, and 1% by mass or less Ni, and the structure of the austenitic-ferritic stainless steels of the present invention has 10 to 85% by volume of the austenite phase in the total structure.

The reasons of specification of ingredients are described below.

Si: 0.4% by mass or less

The limitation of Si content is important in the present invention. Silicon is an effective element as deoxidizer, and it can be added at need. To attain the effect, 0.01% by mass or more of the Si content is preferable. If, however, the Si content exceeds 0.4% by mass, the degree of solid solution of N decreases, which often deteriorates the corrosion resistance because of the sensitization described in the "Background." Therefore, the Si content is limited to 0.4% by mass or less, and preferably 0.38% by mass or less.

Mn: more than 2% by mass and less than 4% by mass

More than 2% by mass of Mn increases the solubility of N, thus making the N-addition during steel making process easy. At the same time, Mn addition increases the percentage of austenite-phase. If, however, the Mn content becomes 4% by mass or more, the effect of austenite-phase formation saturates. Therefore, the Mn content is limited to a range of more than 2% by mass and less than 4% by mass. A preferable range of the Mn content is from 2.2% to 3.8% by mass.

Ni: 1% by mass or less

In view of economy and resource-conservation, the Ni content is limited to 1% by mass or less, and preferably 0.9% or less by mass. To attain excellent toughness, 0.1% by mass or more of the Ni content is preferred.

Percentage of austenite phase: 10 to 85%

Less than 10% of the austenite phase cannot attain the excellent corrosion resistance expected from the reduction of Si content. On the other hand, if the percentage of austenite phase exceeds 85%, the sensitization to stress corrosion cracking significantly increases. Accordingly, the percentage of austenite phase is limited to a range from 10 to 85%, and preferably from 15 to 80%.

To further assure the ductility and the deep drawability, the austenitic-ferritic stainless steels are preferably limited to have the amount of (C+N) in the austenite phase of the steel structure in a range from 0.16 to 2% by mass. If the amount of (C+N) in the austenite phase of the steel structure is less than 0.16% by mass, satisfactory ductility and deep drawability cannot be obtained. On the other hand, the amount of (C+N) more than 2% by mass is difficult to attain. Therefore, preferably the amount of (C+N) is limited to a range from 0.2 to 2% by mass.

The amount of C and N in the austenite phase can be controlled by adjusting the steel composition and the annealing conditions (temperature and time). The relation between the steel structure, the annealing condition, and the amount of C and N in the austenite phase cannot generally be defined. However, appropriate amount of C and N can be adjusted based on the empirical knowledge such that large amount of Cr, C, and N in the steel structure often leads to increase in the amount of C and N in the austenite phase, and that, with the same composition of steel, smaller percentage of austenite phase determined by the annealing condition often increases more with the increase in the amount of C and N in the austenite phase. The determination of the amount of C and N in the austenite phase can be done by, for example, EPMA.

Example 7

Steels having various compositions given in Table 14A were ingoted by vacuum melting or in an atmosphere with controlled nitrogen partial pressures up to 0.9 atm to prepare the respective steel slabs (or ingots or cast). The slabs were heated to 1250° C., and were treated by hot-rolling (10 to 11 passes to hot-roll to 6 mm in thickness), annealing the hot-rolled sheets at 1100° C., descaling thereof by surface grinding, and cold-rolling (at room temperature) to prepare the respective cold-rolled sheets. The obtained cold-rolled sheets were treated by finish-annealing (air-cooling) at 1050° C. to prepare the cold-rolled and annealed sheets.

The prepared cold-rolled and annealed sheets underwent the observation of structure and the determination of corrosion resistance. The result is given in Table 14A. The structure observation (the determination of the percentage of austenite phase was given in a similar manner with that of Example 1. The method for determining and evaluating the intergranular corrosion resistance is given below.

<Determination and Evaluation of Intergranular Corrosion Resistance>

The cold-rolled and annealed sheet was polished on the surface thereof by Emery #300 before the evaluation.

Test solution: A 100 mg of copper(II) sulfate 5 hydrate and 100 ml of sulfuric acid were added to water to prepare 1000 ml solution of sulfuric acid and copper(I) sulfate.

Test method: A test piece was dipped in the boiling above solution for 8 hours. After that, the test piece was taken out from the solution, and was bent to a bending radius of 4.5 mm and the bent angle of 90°. The bent test piece was observed to identify the crack generation at the bent part.

As shown in Table 14A, the steels No. 1 and No. 2 gave no crack caused by corrosion at grain boundaries, and showed superior intergranular corrosion resistance. To the contrary, the steels No. 3 and No. 4 which are the comparative examples gave cracks by corrosion at the grain boundaries.

Table 14B shows the evaluation of intergranular corrosion resistance of the steel Nos. 5 to 8 of the steel sheets of Table 1 and Table 2 in Example 1, applying the same method as above. All these steel sheets have excellent intergranular corrosion resistance, as well as the excellent formability given in Table 2.

Also for the hot-rolled sheets which were prepared by hot-rolling the steel No. 1 and No. 2 in Table 14A to 4.5 mm in thickness, (at 1000° C. of finish temperature), and for the hot-rolled and annealed sheets which were prepared by further annealing the hot-rolled sheets at 1050° C. for 1 minute, the same procedure as that for the cold-rolled and annealed sheets was applied to determine and evaluate the percentage of austenite phase and the intergranular corrosion resistance. For the hot-rolled sheets, the percentage of austenite phase was 60% and 60%, respectively to the steel No. 1 and the steel No. 2. For the hot-rolled and annealed sheets, the percentage of austenite phase was 58% and 59%, respectively to the steel No. 1 and the steel No. 2. There was observed no crack caused by corrosion at grain boundaries for both the hot-rolled sheets and the hot-rolled and annealed sheets, giving excellent intergranular corrosion resistance. As a result, both the hot-rolled sheets and the hot-rolled and annealed sheets showed the performance equivalent to that of the cold-rolled and annealed sheets.

INDUSTRIAL APPLICABILITY

The technology relating to the austenitic-ferritic stainless steels herein is not limited to the steel sheets. For the case of application to, for example, thick plates, shape steels, wires and rods, and pipes, there can be provided, adding to the excellent ductility and deep drawability, excellent punch stretchability, crevice corrosion resistance, corrosion resistance at welded part, and intergranular corrosion resistance, by satisfying the conditions of the present invention.

In addition, the steel sheets are favorably applied as the base materials of automobile members, kitchenware, building brackets, and the like.

Furthermore, for other uses than automobile members, kitchenware, and building brackets, the steel sheets according to the present invention are favorably applied as the materials in the fields which request excellent ductility, deep drawability, punch stretchability, and further, excellent crevice corrosion resistance, corrosion resistance at welded part, and intergranular corrosion resistance.

TABLE 1

| | Chemical composition (mass %) | | | | | | | | | |
|---|---|---|---|---|---|---|---|---|---|---|
| Steel No. | C | N | Si | Mn | P | S | Cr | Ni | Cu | Mo |
| 1 | 0.007 | 0.32 | 0.07 | 0.04 | 0.005 | 0.002 | 23.72 | 0.01 | — | — |
| 2 | 0.100 | 0.31 | 0.05 | 0.04 | 0.005 | 0.002 | 24.01 | — | — | — |
| 3 | 0.010 | 0.20 | 0.33 | 0.89 | 0.030 | 0.002 | 20.06 | 0.51 | 0.53 | — |
| 4 | 0.010 | 0.24 | 0.36 | 0.98 | 0.028 | 0.002 | 21.01 | 0.55 | 0.49 | — |
| 5 | 0.013 | 0.18 | 0.31 | 3.01 | 0.030 | 0.001 | 18.95 | 0.51 | 0.51 | — |
| 6 | 0.012 | 0.22 | 0.25 | 2.88 | 0.029 | 0.001 | 19.93 | 0.51 | 0.52 | — |
| 7 | 0.011 | 0.26 | 0.35 | 2.98 | 0.026 | 0.001 | 21.03 | 0.48 | 0.48 | — |
| 8 | 0.010 | 0.30 | 0.30 | 3.00 | 0.028 | 0.002 | 22.10 | 0.49 | 0.51 | — |
| 9 | 0.015 | 0.20 | 0.55 | 3.03 | 0.030 | 0.001 | 19.02 | 0.50 | 0.63 | — |
| 10 | 0.018 | 0.23 | 0.54 | 3.03 | 0.029 | 0.002 | 20.11 | 0.50 | 0.61 | — |
| 11 | 0.015 | 0.27 | 0.61 | 3.02 | 0.031 | 0.002 | 21.08 | 0.49 | 0.62 | — |
| 12 | 0.007 | 0.23 | 0.35 | 4.88 | 0.029 | 0.002 | 19.38 | 0.47 | 0.51 | — |
| 13 | 0.008 | 0.26 | 0.35 | 4.99 | 0.031 | 0.002 | 20.03 | 0.48 | 0.50 | — |
| 14 | 0.008 | 0.29 | 0.31 | 4.99 | 0.028 | 0.002 | 20.53 | 0.63 | 0.53 | — |
| 15 | 0.018 | 0.24 | 0.36 | 4.99 | 0.030 | 0.001 | 20.21 | 0.46 | 0.49 | — |
| 16 | 0.033 | 0.16 | 0.34 | 4.99 | 0.029 | 0.001 | 18.81 | 0.48 | 0.50 | — |
| 17 | 0.035 | 0.18 | 0.34 | 4.82 | 0.028 | 0.001 | 19.22 | 0.48 | 0.49 | — |
| 18 | 0.054 | 0.22 | 0.33 | 4.90 | 0.029 | 0.001 | 20.33 | 0.46 | 0.50 | — |
| 19 | 0.060 | 0.26 | 0.34 | 4.87 | 0.029 | 0.001 | 21.21 | 0.45 | 0.49 | — |
| 20 | 0.065 | 0.31 | 0.35 | 4.85 | 0.028 | 0.001 | 22.37 | 0.46 | 0.49 | — |
| 21 | 0.069 | 0.21 | 0.33 | 4.81 | 0.029 | 0.001 | 20.23 | 0.48 | 0.49 | — |
| 22 | 0.110 | 0.17 | 0.34 | 4.81 | 0.030 | 0.001 | 20.32 | 0.45 | 0.49 | — |
| 23 | 0.020 | 0.42 | 0.41 | 4.90 | 0.026 | 0.002 | 24.01 | 0.50 | 0.90 | — |
| 24 | 0.017 | 0.26 | 0.34 | 4.42 | 0.030 | 0.001 | 20.45 | 0.12 | 2.03 | — |
| 25 | 0.013 | 0.16 | 0.33 | 4.46 | 0.022 | 0.002 | 21.50 | 0.58 | 0.58 | — |
| 26 | 0.019 | 0.24 | 0.35 | 4.48 | 0.023 | 0.003 | 20.01 | — | — | — |
| 27 | 0.021 | 0.24 | 0.35 | 4.48 | 0.023 | 0.002 | 20.03 | 0.25 | — | — |
| 28 | 0.018 | 0.24 | 0.35 | 4.48 | 0.022 | 0.003 | 19.95 | — | 0.24 | — |
| 29 | 0.020 | 0.22 | 0.34 | 4.49 | 0.023 | 0.002 | 16.91 | 0.25 | 0.24 | 3.02 |
| 30 | 0.013 | 0.19 | 0.51 | 3.01 | 0.028 | 0.002 | 18.89 | 1.51 | — | — |
| 31 | 0.012 | 0.21 | 0.51 | 3.00 | 0.025 | 0.002 | 20.00 | 1.48 | — | — |
| 32 | 0.010 | 0.23 | 0.49 | 2.98 | 0.021 | 0.002 | 21.12 | 1.51 | — | — |
| 33 | 0.021 | 0.26 | 0.51 | 2.99 | 0.028 | 0.001 | 22.03 | 1.50 | — | — |
| 34 | 0.019 | 0.15 | 0.48 | 2.88 | 0.031 | 0.001 | 20.03 | 1.51 | 2.11 | — |
| 35 | 0.013 | 0.24 | 0.31 | 2.88 | 0.028 | 0.002 | 17.11 | 1.50 | 0.50 | 3.12 |
| 36 | 0.020 | 0.20 | 0.48 | 0.99 | 0.029 | 0.002 | 20.50 | 2.60 | — | — |
| 37 | 0.025 | 0.02 | 0.46 | 1.32 | 0.020 | 0.001 | 23.93 | 4.65 | — | — |
| 38 | 0.031 | 0.02 | 0.48 | 1.39 | 0.020 | 0.001 | 22.51 | 6.10 | — | — |

TABLE 2

| Steel No. | Annealing temp. (° C.) | Percentage of austenite phase (%) | Ingredients of austenite phase (mass %) C (γ) | N (γ) | Si (γ) | Mn (γ) | Cr (γ) | Ni (γ) | Cu (γ) | Mo (γ) | C + N (γ) | Index Md (γ) | Total elongation (%) | Limited drawing ratio | Remark |
|---|---|---|---|---|---|---|---|---|---|---|---|---|---|---|---|
| 1 | 1150 | 29 | 0.01 | 0.80 | — | — | 23.6 | — | — | — | 0.81 | −147 | 38 | 2.2 | Example |
| 2 | 1150 | 41 | 0.17 | 0.62 | — | — | 22.7 | — | — | — | 0.79 | −125 | 39 | 2.2 | Example |
| 3 | 1050 | 46 | 0.02 | 0.36 | 0.3 | 0.9 | 19.0 | 0.6 | 0.7 | — | 0.38 | 67 | 50 | 2.3 | Example |
| 4 | 1050 | 45 | 0.02 | 0.46 | 0.3 | 1.0 | 20.2 | 0.7 | 0.6 | — | 0.48 | 4 | 52 | 2.3 | Example |
| 5 | 1050 | 56 | 0.02 | 0.28 | 0.3 | 3.1 | 17.7 | 0.6 | 0.6 | — | 0.30 | 107 | 45 | 2.2 | Example |
| 6 | 1050 | 55 | 0.02 | 0.34 | 0.2 | 3.0 | 18.8 | 0.6 | 0.6 | — | 0.36 | 66 | 52 | 2.4 | Example |
| 7 | 1050 | 50 | 0.02 | 0.45 | 0.3 | 3.2 | 20.0 | 0.6 | 0.6 | — | 0.47 | −4 | 52 | 2.3 | Example |
| 8 | 1050 | 48 | 0.02 | 0.54 | 0.3 | 3.2 | 21.2 | 0.6 | 0.6 | — | 0.56 | −62 | 39 | 2.2 | Example |
| 9 | 1050 | 62 | 0.02 | 0.29 | 0.5 | 3.1 | 18.0 | 0.6 | 0.9 | — | 0.31 | 88 | 49 | 2.4 | Example |
| 10 | 1050 | 58 | 0.03 | 0.38 | 0.5 | 3.1 | 19.1 | 0.6 | 0.8 | — | 0.41 | 30 | 60 | 2.4 | Example |
| 11 | 1050 | 55 | 0.02 | 0.44 | 0.6 | 3.2 | 19.9 | 0.6 | 0.8 | — | 0.46 | −6 | 55 | 2.4 | Example |
| 12 | 1050 | 61 | 0.01 | 0.34 | 0.3 | 5.0 | 18.2 | 0.6 | 0.6 | — | 0.35 | 62 | 55 | 2.3 | Example |
| 13 | 1050 | 60 | 0.01 | 0.38 | 0.3 | 5.1 | 18.9 | 0.6 | 0.6 | — | 0.39 | 33 | 61 | 2.4 | Example |
| 14 | 1050 | 62 | 0.01 | 0.44 | 0.3 | 5.4 | 19.6 | 0.9 | 0.6 | — | 0.45 | −15 | 53 | 2.3 | Example |
| 15 | 1050 | 58 | 0.03 | 0.37 | 0.3 | 6.0 | 19.0 | 0.6 | 0.6 | — | 0.40 | 20 | 59 | 2.4 | Example |
| 16 | 1050 | 59 | 0.05 | 0.23 | 0.3 | 5.2 | 17.3 | 0.6 | 0.6 | — | 0.28 | 105 | 39 | 2.2 | Example |
| 17 | 1050 | 60 | 0.05 | 0.26 | 0.3 | 5.2 | 17.8 | 0.6 | 0.6 | — | 0.31 | 84 | 49 | 2.4 | Example |
| 18 | 1050 | 59 | 0.08 | 0.34 | 0.3 | 5.4 | 19.0 | 0.5 | 0.6 | — | 0.42 | 18 | 62 | 2.5 | Example |
| 19 | 1050 | 59 | 0.09 | 0.40 | 0.3 | 5.5 | 20.0 | 0.5 | 0.6 | — | 0.49 | −29 | 48 | 2.4 | Example |
| 20 | 1050 | 57 | 0.10 | 0.51 | 0.3 | 5.6 | 21.3 | 0.5 | 0.6 | — | 0.61 | −103 | 41 | 2.2 | Example |
| 21 | 1050 | 61 | 0.10 | 0.31 | 0.3 | 5.0 | 18.9 | 0.6 | 0.6 | — | 0.41 | 25 | 64 | 2.5 | Example |
| 22 | 1050 | 60 | 0.16 | 0.26 | 0.3 | 5.0 | 18.8 | 0.5 | 0.6 | — | 0.42 | 24 | 64 | 2.5 | Example |
| 23 | 1050 | 56 | 0.03 | 0.69 | 0.4 | 5.1 | 23.0 | 0.6 | 1.1 | — | 0.72 | −191 | 39 | 2.2 | Example |
| 24 | 1050 | 78 | 0.02 | 0.31 | 0.3 | 4.6 | 19.7 | 0.1 | 2.3 | — | 0.33 | 19 | 71 | 2.4 | Example |
| 25 | 1050 | 30 | 0.03 | 0.37 | 0.3 | 4.8 | 19.3 | 0.8 | 0.9 | — | 0.40 | 11 | 48 | 2.3 | Example |
| 26 | 1050 | 45 | 0.04 | 0.45 | 0.3 | 4.7 | 19.0 | — | — | — | 0.49 | 23 | 51 | 2.3 | Example |
| 27 | 1050 | 48 | 0.03 | 0.44 | 0.3 | 4.7 | 19.0 | 0.3 | — | — | 0.47 | 24 | 52 | 2.3 | Example |
| 28 | 1050 | 50 | 0.03 | 0.42 | 0.3 | 4.7 | 18.9 | — | 0.3 | — | 0.45 | 35 | 53 | 2.3 | Example |
| 29 | 1050 | 46 | 0.04 | 0.42 | 0.3 | 4.8 | 16.3 | 0.3 | 0.3 | 2.2 | 0.46 | 15 | 50 | 2.4 | Example |
| 30 | 1050 | 61 | 0.02 | 0.28 | 0.5 | 3.1 | 17.8 | 1.7 | — | — | 0.30 | 90 | 48 | 2.4 | Example |
| 31 | 1050 | 54 | 0.02 | 0.34 | 0.5 | 3.1 | 18.8 | 1.8 | — | — | 0.36 | 45 | 53 | 2.4 | Example |
| 32 | 1050 | 47 | 0.02 | 0.42 | 0.4 | 3.1 | 19.5 | 1.8 | — | — | 0.44 | 0 | 48 | 2.4 | Example |
| 33 | 1050 | 45 | 0.04 | 0.49 | 0.4 | 3.2 | 20.5 | 1.8 | — | — | 0.53 | −57 | 38 | 2.2 | Example |
| 34 | 1050 | 78 | 0.02 | 0.17 | 0.5 | 3.3 | 18.6 | 1.7 | 2.4 | — | 0.19 | 58 | 58 | 2.4 | Example |
| 35 | 1050 | 60 | 0.02 | 0.36 | 0.3 | 3.1 | 16.5 | 1.7 | 0.6 | 2.5 | 0.38 | 9 | 55 | 2.4 | Example |
| 36 | 1050 | 61 | 0.03 | 0.30 | 0.4 | 1.0 | 19.1 | 3.0 | — | — | 0.33 | 38 | 53 | 2.4 | Example |
| 37 | 1050 | 30 | 0.05 | 0.05 | 0.4 | 1.5 | 19.1 | 6.8 | — | — | 0.10 | 30 | 25 | 1.7 | Comparative example |
| 38 | 1050 | 60 | 0.04 | 0.03 | 0.4 | 1.5 | 19.2 | 7.8 | — | — | 0.07 | 14 | 33 | 1.8 | Comparative example |

TABLE 3

| Steel No. | Chemical composition (mass %) C | Si | Mn | P | S | Cr | Ni | N | Al | O | V |
|---|---|---|---|---|---|---|---|---|---|---|---|
| 1 | 0.003 | 0.41 | 0.63 | 0.028 | 0.0011 | 20.3 | 1.30 | 0.003 | — | 0.0035 | — |
| 2 | 0.030 | 0.70 | 1.91 | 0.029 | 0.0022 | 17.9 | 1.83 | 0.080 | — | 0.0051 | 0.058 |
| 3 | 0.021 | 0.54 | 1.06 | 0.031 | 0.0025 | 18.3 | 2.83 | 0.122 | 0.015 | 0.0043 | — |
| 4 | 0.010 | 0.51 | 0.83 | 0.033 | 0.0150 | 20.3 | 1.36 | 0.130 | 0.080 | 0.0021 | 0.011 |
| 5 | 0.010 | 0.55 | 8.45 | 0.030 | 0.0051 | 22.5 | 1.39 | 0.296 | — | 0.0035 | 0.055 |
| 6 | 0.035 | 0.45 | 1.55 | 0.030 | 0.0081 | 29.8 | 1.61 | 0.521 | 0.012 | 0.0081 | 0.121 |
| 7 | 0.110 | 0.55 | 1.31 | 0.028 | 0.0035 | 21.2 | 1.22 | 0.150 | 0.012 | 0.0033 | — |
| 8 | 0.020 | 0.55 | 0.43 | 0.027 | 0.0035 | 21.0 | 1.31 | 0.151 | — | 0.0032 | — |
| 9 | 0.011 | 0.81 | 0.88 | 0.030 | 0.0004 | 22.3 | 1.61 | 0.162 | 0.008 | 0.0015 | — |
| 10 | 0.021 | 0.50 | 1.50 | 0.028 | 0.0026 | 22.5 | 5.71 | 0.161 | 0.013 | 0.0055 | — |
| 11 | 0.031 | 0.36 | 0.81 | 0.031 | 0.0029 | 21.6 | 1.81 | 0.182 | — | 0.0026 | — |
| 12 | 0.031 | 0.53 | 1.10 | 0.029 | 0.0006 | 22.5 | 1.53 | 0.181 | — | 0.0013 | — |
| 13 | 0.051 | 0.61 | 0.93 | 0.030 | 0.0011 | 22.9 | 1.46 | 0.181 | — | 0.0015 | — |
| 14 | 0.026 | 0.36 | 0.58 | 0.030 | 0.0013 | 22.7 | 1.50 | 0.163 | — | 0.0031 | — |
| 15 | 0.031 | 0.41 | 0.63 | 0.028 | 0.0013 | 12.1 | 1.31 | 0.101 | — | 0.0029 | — |
| 16 | 0.053 | 0.36 | 0.91 | 0.028 | 0.0036 | 39.0 | 1.59 | 0.213 | — | 0.0031 | — |

| Steel No. | Chemical composition (mass %) Mo | Cu | B | Ca | Mg | REM | Remark |
|---|---|---|---|---|---|---|---|
| 1 | — | — | — | — | — | — | Comparative steel |

TABLE 3-continued

| | | | | | | | |
|---|---|---|---|---|---|---|---|
| 2 | — | — | — | — | — | — | Inventive steel |
| 3 | — | — | — | — | — | — | Inventive steel |
| 4 | — | — | — | — | — | — | Inventive steel |
| 5 | — | — | — | — | — | — | Inventive steel |
| 6 | — | — | — | — | — | — | Inventive steel |
| 7 | — | — | — | — | — | — | Inventive steel |
| 8 | 3.11 | — | — | — | — | — | Inventive steel |
| 9 | — | — | 0.0026 | — | — | — | Inventive steel |
| 10 | 2.91 | — | — | — | — | — | Comparative steel |
| 11 | — | 2.13 | — | — | — | — | Inventive steel |
| 12 | — | — | — | 0.0036 | — | — | Inventive steel |
| 13 | — | — | — | — | 0.0028 | — | Inventive steel |
| 14 | — | — | — | — | — | 0.0210 | Inventive steel |
| 15 | — | — | — | — | — | — | Comparative steel |
| 16 | — | — | — | — | — | — | Comparative steel |

Note:
Values with underline are outside the range of the present invention.
The mark (—) indicates the inevitable impurity level.

TABLE 4

| No. | Steel No. | Annealing temp. (° C.) | Percentage of austenite-phase (%) | Amount of C and N in austenite-phase (mass %) C | N | C + N | Limited drawing ratio | Remark |
|---|---|---|---|---|---|---|---|---|
| 1 | 1 | 1050 | 0 | — | — | — | 2.0 | Comparative Example |
| 2 | 2 | 950 | 75 | 0.03 | 0.10 | 0.13 | 2.0 | Comparative Example |
| 3 | 2 | 1050 | 60 | 0.03 | 0.12 | 0.15 | 2.0 | Comparative Example |
| 4 | 2 | 1100 | 49 | 0.03 | 0.14 | 0.17 | 2.4 | Example |
| 5 | 2 | 1150 | 36 | 0.04 | 0.16 | 0.20 | 2.3 | Example |
| 6 | 2 | 1200 | 22 | 0.05 | 0.20 | 0.25 | 2.2 | Example |
| 7 | 2 | 1230 | 13 | 0.06 | 0.22 | 0.28 | 2.1 | Example |
| 8 | 2 | 1250 | 6 | 0.06 | 0.24 | 0.30 | 2.0 | Comparative Example |
| 9 | 3 | 950 | 90 | 0.01 | 0.13 | 0.14 | 1.9 | Comparative Example |
| 10 | 3 | 1050 | 79 | 0.01 | 0.15 | 0.16 | 2.4 | Example |
| 11 | 3 | 1150 | 57 | 0.02 | 0.19 | 0.21 | 2.4 | Example |
| 12 | 3 | 1250 | 28 | 0.02 | 0.26 | 0.28 | 2.3 | Example |
| 13 | 4 | 950 | 49 | 0.02 | 0.25 | 0.27 | 2.4 | Example |
| 14 | 4 | 1050 | 38 | 0.02 | 0.29 | 0.31 | 2.4 | Example |
| 15 | 4 | 1150 | 22 | 0.03 | 0.38 | 0.41 | 2.3 | Example |
| 16 | 4 | 1250 | 3 | 0.04 | 0.53 | 0.57 | 2.0 | Comparative Example |
| 17 | 5 | 1050 | 52 | 0.01 | 0.52 | 0.53 | 2.6 | Example |
| 18 | 5 | 1150 | 36 | 0.01 | 0.65 | 0.66 | 2.5 | Example |
| 19 | 5 | 1250 | 18 | 0.01 | 0.85 | 0.86 | 2.2 | Example |
| 20 | 5 | 1300 | 8 | 0.02 | 0.97 | 0.99 | 2.0 | Comparative Example |
| 21 | 6 | 1200 | 26 | 0.09 | 1.50 | 1.59 | 2.3 | Example |
| 22 | 6 | 1250 | 21 | 0.09 | 1.56 | 1.65 | 2.2 | Example |
| 23 | 6 | 1300 | 14 | 0.10 | 1.61 | 1.71 | 2.1 | Example |
| 24 | 7 | 1050 | 53 | 0.18 | 0.26 | 0.44 | 2.6 | Example |
| 25 | 8 | 1050 | 35 | 0.04 | 0.36 | 0.40 | 2.5 | Example |
| 26 | 9 | 1050 | 29 | 0.03 | 0.45 | 0.48 | 2.5 | Example |
| 27 | 10 | 1050 | 53 | 0.03 | 0.26 | 0.29 | 1.8 | Comparative |

TABLE 4-continued

| No. | Steel No. | Annealing temp. (° C.) | Percentage of austenite-phase (%) | Amount of C and N in austenite-phase (mass %) C | N | C + N | Limited drawing ratio | Remark |
|---|---|---|---|---|---|---|---|---|
| | | | | | | | | Example |
| 28 | 11 | 1100 | 43 | 0.06 | 0.35 | 0.41 | 2.5 | Example |
| 29 | 12 | 1100 | 31 | 0.09 | 0.51 | 0.60 | 2.3 | Example |
| 30 | 13 | 1100 | 35 | 0.11 | 0.38 | 0.49 | 2.3 | Example |
| 31 | 14 | 1100 | 30 | 0.07 | 0.41 | 0.48 | 2.3 | Example |
| 32 | 15 | 1050 | 100 | 0.03 | 0.10 | 0.13 | 1.7 | Comparative Example |
| 33 | 16 | 1050 | 0 | — | — | — | 1.9 | Comparative Example |

Note:
Values with underline are outside the range of the present invention.

TABLE 5

| Steel sheet No. | Chemical composition (mass %) C | Si | Mn | P | S | Cr | Ni | Cu | Al | V | N | O | Other | Remark |
|---|---|---|---|---|---|---|---|---|---|---|---|---|---|---|
| 1 | 0.022 | 0.51 | 0.95 | 0.025 | 0.0031 | 14.70 | 0.24 | 0.51 | 0.015 | 0.028 | 0.050 | 0.0028 | — | Comparative Example |
| 2 | 0.020 | 0.43 | 1.03 | 0.031 | 0.0055 | 17.93 | 0.01 | 0.01 | 0.015 | 0.055 | 0.108 | 0.0035 | — | Example |
| 3 | 0.025 | 0.41 | 1.11 | 0.025 | 0.0054 | 21.30 | 0.26 | 0.51 | 0.005 | 0.001 | 0.202 | 0.0044 | — | Example |
| 4 | 0.005 | 0.52 | 0.22 | 0.033 | 0.0061 | 25.30 | 0.62 | 0.55 | 0.001 | 0.043 | 0.375 | 0.0055 | — | Example |
| 5 | 0.025 | 0.44 | 0.98 | 0.028 | 0.0088 | 29.20 | 0.31 | 0.53 | 0.005 | 0.055 | 0.511 | 0.0121 | — | Example |
| 6 | 0.004 | 0.51 | 0.13 | 0.030 | 0.0083 | 17.96 | 0.26 | 0.01 | 0.015 | 0.001 | 0.113 | 0.0051 | — | Example |
| 7 | 0.015 | 0.46 | 1.91 | 0.029 | 0.0053 | 18.03 | 0.42 | 0.01 | 0.015 | 0.001 | 0.109 | 0.0034 | — | Example |
| 8 | 0.021 | 0.53 | 2.28 | 0.026 | 0.0033 | 18.13 | 0.33 | 0.01 | 0.016 | 0.001 | 0.103 | 0.0066 | — | Comparative Example |
| 9 | 0.020 | 0.46 | 3.88 | 0.028 | 0.0035 | 18.03 | 0.26 | 0.01 | 0.015 | 0.001 | 0.111 | 0.0028 | — | Comparative Example |
| 10 | 0.035 | 0.44 | 1.05 | 0.033 | 0.0018 | 21.51 | 0.83 | 1.22 | 0.003 | 0.053 | 0.305 | 0.0025 | — | Example |
| 11 | 0.111 | 0.48 | 1.02 | 0.025 | 0.0011 | 21.41 | 0.01 | 0.32 | 0.001 | 0.051 | 0.120 | 0.0055 | — | Example |
| 12 | 0.021 | 0.53 | 1.00 | 0.031 | 0.0051 | 21.08 | 0.31 | 0.36 | 0.005 | 0.055 | 0.081 | 0.0031 | — | Example |
| 13 | 0.018 | 0.10 | 0.98 | 0.025 | 0.0041 | 21.22 | 0.33 | 0.51 | 0.006 | 0.046 | 0.055 | 0.0055 | — | Example |
| 14 | 0.018 | 0.51 | 1.11 | 0.033 | 0.0035 | 21.60 | 0.03 | 0.91 | 0.005 | 0.055 | 0.043 | 0.0041 | — | Comparative Example |
| 15 | 0.010 | 0.53 | 0.95 | 0.025 | 0.0028 | 21.03 | 0.31 | 0.53 | 0.005 | 0.036 | 0.013 | 0.0036 | — | Comparative Example |
| 16 | 0.020 | 0.81 | 0.83 | 0.025 | 0.0023 | 17.88 | 0.43 | 2.18 | 0.012 | 0.028 | 0.113 | 0.0055 | Mo: 3.10 | Example |
| 17 | 0.008 | 0.56 | 0.85 | 0.013 | 0.0004 | 20.93 | 0.43 | 0.01 | 0.012 | 0.111 | 0.232 | 0.0018 | B: 0.0026, Ca: 0.0030, Mg: 0.0025, REM: 0.0021, Ti: 0.010 | Example |
| 18 | 0.010 | 0.55 | 0.66 | 0.033 | 0.0005 | 21.00 | 0.39 | 0.01 | 0.013 | 0.055 | 0.222 | 0.0031 | B: 0.0025, Ca: 0.0022 | Example |
| 19 | 0.043 | 0.51 | 0.38 | 0.026 | 0.0038 | 16.31 | 0.19 | 0.01 | 0.004 | 0.028 | 0.025 | 0.0033 | — | Comparative Example |
| 20 | 0.023 | 0.49 | 1.44 | 0.031 | 0.0028 | 22.81 | 5.44 | 0.01 | 0.005 | 0.051 | 0.025 | 0.0028 | Mo: 2.88 | Comparative Example |
| 21 | 0.121 | 0.66 | 1.05 | 0.028 | 0.0051 | 17.10 | 7.11 | 0.01 | 0.005 | 0.041 | 0.021 | 0.0028 | — | Comparative Example |
| 22 | 0.051 | 0.55 | 1.03 | 0.028 | 0.0046 | 18.85 | 9.03 | 0.01 | 0.006 | 0.033 | 0.018 | 0.0031 | — | Comparative Example |
| 23 | 0.007 | 0.07 | 0.04 | 0.005 | 0.002 | 23.72 | 0.01 | 0.36 | 0.031 | 0.001 | 0.32 | 0.0029 | — | Example |
| 24 | 0.110 | 0.05 | 0.04 | 0.005 | 0.002 | 24.01 | 0.43 | 0.41 | 0.010 | 0.001 | 0.31 | 0.0041 | — | Example |
| 25 | 0.090 | 0.33 | 0.89 | 0.030 | 0.002 | 20.06 | 0.51 | 0.53 | 0.005 | 0.050 | 0.20 | 0.0036 | — | Example |
| 26 | 0.010 | 0.36 | 0.98 | 0.028 | 0.002 | 21.01 | 0.55 | 0.49 | 0.036 | 0.049 | 0.24 | 0.0015 | — | Example |

TABLE 6A

| Steel sheet No. | Percentage of austenite phase (vol %) | Corrosion resistance Erichsen value (mm) | Mother material part | Crevice zone | Remark |
|---|---|---|---|---|---|
| 1 | 66 | 7.3 | x | x | Comparative Example |

TABLE 6A-continued

| Steel sheet No. | Percentage of austenite phase (vol %) | Corrosion resistance Erichsen value (mm) | Mother material part | Crevice zone | Remark |
|---|---|---|---|---|---|
| 2 | 43 | 14.5 | ○ | ○ | Example |
| 3 | 47 | 14.7 | ○ | ○ | Example |

TABLE 6A-continued

| Steel sheet No. | Percentage of austenite phase (vol %) | Erichsen value (mm) | Corrosion resistance: Mother material part | Corrosion resistance: Crevice zone | Remark |
|---|---|---|---|---|---|
| 4 | 43 | 14.2 | ○ | ○ | Example |
| 5 | 29 | 13.1 | ○ | ○ | Example |
| 6 | 49 | 14.8 | ○ | ○ | Example |
| 7 | 45 | 13.5 | ○ | ○ | Example |
| 8 | 47 | 11.6 | ○ | x | Comparative Example |
| 9 | 50 | 10.6 | x | x | Comparative Example |
| 10 | 82 | 15.1 | ○ | ○ | Example |
| 11 | 30 | 14.1 | ○ | ○ | Example |
| 12 | 18 | 13.2 | ○ | ○ | Example |
| 13 | 12 | 12.3 | ○ | ○ | Example |
| 14 | 7 | 10.3 | ○ | ○ | Comparative Example |
| 15 | 0 | 8.2 | ○ | ○ | Comparative Example |
| 16 | 43 | 14.4 | ○ | ○ | Example |
| 17 | 53 | 14.5 | ○ | ○ | Example |
| 18 | 48 | 14.3 | ○ | ○ | Example |
| 19 | 0 | 8.6 | x | x | Comparative Example |
| 20 | 53 | 8.7 | ○ | ○ | Comparative Example |
| 21 | 100 | 13.9 | x | x | Comparative Example |
| 22 | 100 | 12.2 | ○ | x | Comparative Example |
| 23 | 37 | 13.7 | ○ | ○ | Example |

TABLE 6A-continued

| Steel sheet No. | Percentage of austenite phase (vol %) | Erichsen value (mm) | Corrosion resistance: Mother material part | Corrosion resistance: Crevice zone | Remark |
|---|---|---|---|---|---|
| 24 | 43 | 14.2 | ○ | ○ | Example |
| 25 | 40 | 14.0 | ○ | ○ | Example |
| 26 | 35 | 13.0 | ○ | ○ | Example |

TABLE 6B

| Steel No. | Percentage of austenite phase (vol %) | Limited drawing ratio (Erichsen value) (mm) | Corrosion resistance at mother material part | Corrosion resistance at crevice zone | Remark |
|---|---|---|---|---|---|
| Steel No. 1 of Tables 1 and 2 | 29 | 14.0 | ○ | ○ | Example |
| Steel No. 2 of Tables 1 and 2 | 41 | 14.8 | ○ | ○ | Example |
| Steel No. 3 of Tables 1 and 2 | 46 | 14.6 | ○ | ○ | Example |
| Steel No. 4 of Tables 1 and 2 | 45 | 14.5 | ○ | ○ | Example |

TABLE 7

| Steel sheet No. | Chemical composition: C | Si | Mn | P | S | Cr | Ni | Cu | Al | V | N | O | Other | Remark |
|---|---|---|---|---|---|---|---|---|---|---|---|---|---|---|
| 1 | 0.010 | 0.49 | 5.32 | 0.025 | 0.0031 | 17.8 | 0.49 | 0.48 | 0.009 | 0.041 | 0.058 | 0.0031 | — | Example |
| 2 | 0.009 | 0.51 | 5.28 | 0.023 | 0.0033 | 19.9 | 0.43 | 0.51 | 0.009 | 0.051 | 0.159 | 0.0026 | — | Example |
| 3 | 0.010 | 0.53 | 5.31 | 0.025 | 0.0025 | 22.1 | 0.55 | 0.46 | 0.011 | 0.030 | 0.262 | 0.0031 | — | Example |
| 4 | 0.011 | 0.52 | 5.26 | 0.025 | 0.0055 | 26.3 | 0.43 | 0.50 | 0.012 | 0.051 | 0.463 | 0.0066 | — | Example |
| 5 | 0.012 | 0.49 | 0.98 | 0.031 | 0.0028 | 18.9 | 0.01 | 0.50 | 0.005 | 0.028 | 0.169 | 0.0030 | — | Comparative Example |
| 6 | 0.011 | 0.55 | 3.42 | 0.026 | 0.0022 | 19.0 | 0.01 | 0.48 | 0.001 | 0.026 | 0.165 | 0.0028 | — | Comparative Example |
| 7 | 0.011 | 0.51 | 4.33 | 0.033 | 0.0031 | 19.0 | 0.01 | 0.49 | 0.001 | 0.031 | 0.173 | 0.0031 | — | Example |
| 8 | 0.010 | 0.53 | 5.26 | 0.028 | 0.0016 | 18.8 | 0.01 | 0.50 | 0.006 | 0.051 | 0.171 | 0.0016 | — | Example |
| 9 | 0.012 | 0.51 | 7.31 | 0.033 | 0.0044 | 19.0 | 0.01 | 0.50 | 0.007 | 0.023 | 0.170 | 0.0032 | — | Example |
| 10 | 0.009 | 0.55 | 9.00 | 0.030 | 0.0009 | 18.9 | 0.01 | 0.50 | 0.006 | 0.033 | 0.169 | 0.0055 | — | Example |
| 11 | 0.010 | 0.51 | 11.03 | 0.029 | 0.0021 | 19.0 | 0.01 | 0.52 | 0.005 | 0.016 | 0.170 | 0.0025 | — | Example |
| 12 | 0.012 | 0.49 | 14.89 | 0.020 | 0.0031 | 19.1 | 0.01 | 0.51 | 0.001 | 0.021 | 0.170 | 0.0036 | — | Comparative Example |
| 13 | 0.013 | 0.50 | 5.28 | 0.031 | 0.0055 | 20.1 | 0.01 | 0.01 | 0.015 | 0.001 | 0.040 | 0.0013 | — | Comparative Example |
| 14 | 0.010 | 0.010 | 5.26 | 0.032 | 0.0033 | 19.8 | 0.01 | 0.01 | 0.013 | 0.001 | 0.059 | 0.0034 | — | Example |

TABLE 8

| Steel sheet No. | Chemical composition: C | Si | Mn | P | S | Cr | Ni | Cu | Al | V | N | O | Other | Remark |
|---|---|---|---|---|---|---|---|---|---|---|---|---|---|---|
| 15 | 0.012 | 0.51 | 5.27 | 0.032 | 0.0026 | 20.0 | 0.01 | 0.01 | 0.016 | 0.001 | 0.080 | 0.0026 | — | Example |
| 16 | 0.010 | 0.51 | 5.30 | 0.033 | 0.0031 | 20.0 | 0.01 | 0.01 | 0.015 | 0.001 | 0.129 | 0.0022 | — | Example |
| 17 | 0.010 | 0.50 | 5.27 | 0.028 | 0.0033 | 20.2 | 0.01 | 0.01 | 0.021 | 0.001 | 0.231 | 0.0020 | — | Example |
| 18 | 0.009 | 0.50 | 5.30 | 0.026 | 0.0025 | 20.0 | 0.01 | 0.01 | 0.022 | 0.001 | 0.311 | 0.0033 | — | Example |
| 19 | 0.010 | 0.55 | 5.33 | 0.027 | 0.0018 | 20.1 | 0.81 | 0.73 | 0.013 | 0.001 | 0.292 | 0.0025 | — | Example |
| 20 | 0.012 | 0.46 | 5.31 | 0.028 | 0.0018 | 19.5 | 0.51 | 0.46 | 0.055 | 0.151 | 0.212 | 0.0061 | — | Example |
| 21 | 0.008 | 0.61 | 5.33 | 0.033 | 0.0031 | 20.1 | 0.46 | 2.13 | 0.023 | 0.056 | 0.155 | 0.0081 | — | Example |
| 22 | 0.005 | 0.54 | 5.25 | 0.031 | 0.0061 | 19.6 | 0.53 | 0.55 | 0.015 | 0.066 | 0.188 | 0.0056 | Mo: 3.15 | Example |

TABLE 8-continued

| Steel sheet No. | Chemical composition C | Si | Mn | P | S | Cr | Ni | Cu | Al | V | N | O | Other | Remark |
|---|---|---|---|---|---|---|---|---|---|---|---|---|---|---|
| 23 | 0.006 | 0.55 | 5.28 | 0.028 | 0.0025 | 19.3 | 0.55 | 0.53 | 0.011 | 0.081 | 0.213 | 0.0056 | B: 0.0025 | Example |
| 24 | 0.005 | 0.46 | 5.22 | 0.033 | 0.0005 | 19.2 | 0.36 | 0.43 | 0.031 | 0.061 | 0.211 | 0.0022 | Ca: 0.0035 | Example |
| 25 | 0.012 | 0.81 | 5.51 | 0.038 | 0.0006 | 20.3 | 0.51 | 0.55 | 0.015 | 0.081 | 0.199 | 0.0022 | Mg: 0.0033 | Example |
| 26 | 0.008 | 0.55 | 5.33 | 0.029 | 0.0008 | 19.9 | 0.37 | 0.39 | 0.031 | 0.071 | 0.185 | 0.0031 | REM: 0.021 | Example |
| 27 | 0.012 | 0.46 | 5.35 | 0.034 | 0.0009 | 21.0 | 0.36 | 0.51 | 0.012 | 0.077 | 0.185 | 0.0018 | Ti: 0.0025 | Example |

TABLE 9A

| Steel sheet No. | Percentage of austenite phase (vol %) | Occurrence/not-occurrence of corrosion* 100 mV | 200 mV | 300 mV | Remark |
|---|---|---|---|---|---|
| 1 | 48 | ○ | ○ | x | Example |
| 2 | 55 | ○ | ○ | ○ | Example |
| 3 | 53 | ○ | ○ | ○ | Example |
| 4 | 28 | ○ | ○ | ○ | Example |
| 5 | 51 | x | x | x | Comparative Example |
| 6 | 55 | x | x | x | Comparative Example |
| 7 | 57 | ○ | ○ | ○ | Example |
| 8 | 56 | ○ | ○ | ○ | Example |
| 9 | 56 | ○ | ○ | ○ | Example |
| 10 | 60 | ○ | ○ | ○ | Example |
| 11 | 58 | ○ | ○ | x | Example |
| 12 | 55 | ○ | x | x | Comparative Example |
| 13 | 5 | x | x | x | Comparative Example |
| 14 | 12 | ○ | ○ | x | Example |
| 15 | 17 | ○ | ○ | ○ | Example |
| 16 | 30 | ○ | ○ | ○ | Example |
| 17 | 51 | ○ | ○ | ○ | Example |
| 18 | 65 | ○ | ○ | ○ | Example |
| 19 | 85 | ○ | ○ | ○ | Example |
| 20 | 46 | ○ | ○ | ○ | Example |
| 21 | 53 | ○ | ○ | ○ | Example |
| 22 | 41 | ○ | ○ | ○ | Example |
| 23 | 55 | ○ | ○ | ○ | Example |
| 24 | 56 | ○ | ○ | ○ | Example |
| 25 | 50 | ○ | ○ | ○ | Example |
| 26 | 46 | ○ | ○ | ○ | Example |
| 27 | 43 | ○ | ○ | ○ | Example |

*○: no corrosion occurred, x: corrosion occurred.

TABLE 9B

| Steel sheet No. | Percentage of austenite phase (vol %) | Occurrence/not-occurrence of corrosion* 100 mV | 200 mV | 300 mV | Remark |
|---|---|---|---|---|---|
| Steel No. 12 of Table1 1 and 2 | 61 | ○ | ○ | ○ | Example |
| Steel No. 13 of Table1 1 and 2 | 60 | ○ | ○ | ○ | Example |
| Steel No. 14 of Table1 1 and2 | 62 | ○ | ○ | ○ | Example |
| Steel No. 15 of Table1 1 and2 | 58 | ○ | ○ | ○ | Example |
| Steel No. 16 of Table1 1 and 2 | 59 | ○ | ○ | ○ | Example |
| Steel No. 17 of Table1 1 and 2 | 60 | ○ | ○ | ○ | Example |
| Steel No. 18 of Table1 1 and 2 | 59 | ○ | ○ | ○ | Example |
| Steel No. 19 of Table1 1 and 2 | 59 | ○ | ○ | ○ | Example |
| Steel No. 20 of Table1 1 and 2 | 57 | ○ | ○ | ○ | Example |
| Steel No. 21 of Table1 1 and 2 | 61 | ○ | ○ | ○ | Example |
| Steel No. 22 of Table1 1 and 2 | 60 | ○ | ○ | ○ | Example |
| Steel No. 23 of Table1 1 and 2 | 56 | ○ | ○ | ○ | Example |
| Steel No. 24 of Table1 1 and 2 | 78 | ○ | ○ | ○ | Example |
| Steel No. 25 of Table1 1 and 2 | 30 | ○ | ○ | ○ | Example |
| Steel No. 26 of Table1 1 and 2 | 45 | ○ | ○ | ○ | Example |
| Steel No. 27 of Table1 1 and 2 | 48 | ○ | ○ | ○ | Example |
| Steel No. 28 of Table1 1 and 2 | 50 | ○ | ○ | ○ | Example |
| Steel No. 29 of Table1 1 and 2 | 46 | ○ | ○ | ○ | Example |

TABLE 10

| Steel sheet No. | Chemical composition C | Si | Mn | P | S | Cr | Ni | Cu | Al | V | N | O | Other | Remark |
|---|---|---|---|---|---|---|---|---|---|---|---|---|---|---|
| 31 | 0.021 | 0.41 | 5.01 | 0.013 | 0.0013 | 20.00 | 0.51 | 0.49 | 0.028 | 0.028 | 0.241 | 0.0031 | — | Example |
| 32 | 0.023 | 0.35 | 6.79 | 0.031 | 0.0010 | 19.88 | 0.48 | 0.55 | 0.001 | 0.033 | 0.238 | 0.0019 | — | Example |
| 33 | 0.024 | 0.28 | 4.89 | 0.033 | 0.0015 | 20.13 | 0.55 | 0.48 | 0.028 | 0.001 | 0.251 | 0.0031 | — | Example |
| 34 | 0.022 | 0.34 | 4.10 | 0.028 | 0.0013 | 20.21 | 0.48 | 0.46 | 0.001 | 0.001 | 0.244 | 0.0025 | — | Example |
| 35 | 0.050 | 0.36 | 5.01 | 0.028 | 0.0009 | 20.25 | 0.47 | 0.55 | 0.025 | 0.054 | 0.216 | 0.0028 | — | Example |
| 36 | 0.093 | 0.37 | 5.11 | 0.030 | 0.0022 | 19.55 | 0.46 | 0.53 | 0.028 | 0.025 | 0.183 | 0.0031 | — | Example |
| 37 | 0.110 | 0.39 | 4.99 | 0.033 | 0.0015 | 20.33 | 0.53 | 0.51 | 0.033 | 0.055 | 0.157 | 0.0029 | — | Example |
| 38 | 0.130 | 0.40 | 5.01 | 0.031 | 0.0016 | 20.25 | 0.46 | 0.50 | 0.028 | 0.033 | 0.137 | 0.0025 | — | Example |

TABLE 11

| Steel sheet No. | Percentage of austenite phase (vol %) | Result of stress corrosion cracking test | | | | | | | |
|---|---|---|---|---|---|---|---|---|---|
| | | Mother material part | | | | Welded part | | | |
| | | 24 h | 48 h | 72 h | 96 h | 24 h | 48 h | 72 h | 96 h |
| 31 | 58 | ○ | ○ | ○ | ○ | ○ | ○ | ○ | ○ |
| 32 | 56 | ○ | ○ | ○ | ○ | ○ | ○ | ○ | ○ |
| 33 | 63 | ○ | ○ | ○ | ○ | ○ | ○ | ○ | ○ |
| 34 | 56 | ○ | ○ | ○ | ○ | ○ | ○ | ○ | ○ |
| 35 | 57 | ○ | ○ | ○ | ○ | ○ | ○ | ○ | ○ |
| 36 | 58 | ○ | ○ | ○ | ○ | ○ | ○ | ○ | ○ |
| 37 | 58 | ○ | x | — | — | ○ | x | — | — |
| 38 | 57 | x | — | — | — | x | — | — | — |

TABLE 12

| Steel sheet No. | Chemical composition | | | | | | | | | | | | | Remark |
|---|---|---|---|---|---|---|---|---|---|---|---|---|---|---|
| | C | Si | Mn | P | S | Cr | Ni | Cu | Al | V | N | O | Other | |
| 41 | 0.018 | 0.35 | 4.95 | 0.028 | 0.0011 | 20.11 | 0.02 | 0.51 | 0.031 | 0.001 | 0.235 | 0.0025 | — | Example |
| 42 | 0.021 | 0.43 | 5.13 | 0.031 | 0.0015 | 20.12 | 0.08 | 0.49 | 0.035 | 0.033 | 0.241 | 0.0031 | — | Example |
| 43 | 0.022 | 0.31 | 5.21 | 0.028 | 0.0013 | 20.15 | 0.10 | 0.50 | 0.029 | 0.031 | 0.251 | 0.0025 | — | Example |
| 44 | 0.018 | 0.35 | 4.10 | 0.028 | 0.0015 | 20.21 | 0.12 | 0.51 | 0.030 | 0.033 | 0.233 | 0.0026 | — | Example |
| 45 | 0.020 | 0.36 | 5.31 | 0.029 | 0.0009 | 20.01 | 0.28 | 0.50 | 0.033 | 0.054 | 0.241 | 0.0027 | — | Example |
| 46 | 0.021 | 0.35 | 4.88 | 0.033 | 0.0015 | 20.01 | 0.50 | 0.50 | 0.030 | 0.025 | 0.240 | 0.0028 | — | Example |
| 47 | 0.019 | 0.39 | 6.75 | 0.028 | 0.0013 | 19.99 | 0.49 | 0.49 | 0.035 | 0.001 | 0.241 | 0.0028 | — | Example |
| 48 | 0.020 | 0.40 | 4.99 | 0.028 | 0.0012 | 20.11 | 0.53 | 0.51 | 0.001 | 0.033 | 0.138 | 0.0031 | — | Example |
| 49 | 0.018 | 0.40 | 5.01 | 0.033 | 0.0011 | 19.93 | 0.48 | 0.51 | 0.001 | 0.001 | 0.244 | 0.0036 | — | Example |
| 50 | 0.018 | 0.51 | 5.05 | 0.031 | 0.0013 | 20.01 | 0.87 | 0.52 | 0.030 | 0.031 | 0.248 | 0.0029 | — | Example |

TABLE 13

| Steel sheet No. | Percentage of austenite phase (vol %) | Absorbed energy ($J/cm^2$) | |
|---|---|---|---|
| | | Mother material part | Welded part |
| 41 | 57 | 148 | 123 |
| 42 | 59 | 179 | 141 |
| 43 | 63 | 190 | 165 |
| 44 | 56 | 191 | 171 |
| 45 | 60 | 195 | 176 |
| 46 | 59 | 198 | 180 |
| 47 | 58 | 197 | 181 |
| 48 | 57 | 199 | 183 |
| 49 | 60 | 198 | 181 |
| 50 | 64 | 203 | 183 |

TABLE 14B

| Steel No. | Percentage of austenite phase (vol %) | Intergranular corrosion resistance | Remark |
|---|---|---|---|
| Steel No. 5 of Tables 1 and 2 | 56 | No crack occurred | Example |
| Steel No. 6 of Tables 1 and 2 | 55 | No crack occurred | Example |
| Steel No. 7 of Tables 1 and 2 | 50 | No crack occurred | Example |
| Steel No. 8 of Tables 1 and 2 | 48 | No crack occurred | Example |

TABLE 14A

| No. | Chemical composition (mass %) | | | | | | | | | | | | Percentage of austenite phase (vol %) | Intergranular corrosion resistance | Remark |
|---|---|---|---|---|---|---|---|---|---|---|---|---|---|---|---|
| | C | Si | Mn | P | S | Cr | Ni | Cu | Al | V | N | O | | | |
| 1 | 0.015 | 0.13 | 3.51 | 0.028 | 0.0021 | 20.13 | 0.61 | 0.48 | 0.025 | 0.022 | 0.241 | 0.0021 | 58 | No crack occurred | Example |
| 2 | 0.016 | 0.38 | 3.66 | 0.026 | 0.0022 | 20.11 | 0.66 | 0.47 | 0.026 | 0.031 | 0.243 | 0.0033 | 59 | No crack occurred | Example |
| 3 | 0.015 | 0.46 | 3.61 | 0.031 | 0.0023 | 20.15 | 0.59 | 0.43 | 0.028 | 0.033 | 0.241 | 0.0026 | 60 | Crack occurred | Comparative Example |
| 4 | 0.015 | 0.61 | 3.55 | 0.028 | 0.0021 | 20.06 | 0.66 | 0.46 | 0.031 | 0.036 | 0.243 | 0.0025 | 58 | Crack occurred | Comparative Example |

The invention claimed is:

1. A resistant to intergranular corrosion austenitic-ferritic stainless steel comprising about 0.2% or less C, 0.31% or less Si, about 2 to 3.03% Mn, about 0.1% or less P, about 0.03% or less S, about 15 to about 35% Cr, about 1% or less Ni, 0.1 to about 0.6% N, by mass, and balance of Fe and inevitable impurities, the percentage of an austenitic phase of the steel being in a range from about 10 to about 85% by volume, the amount of (C+N) in the austenite phase being, in a range of 0.38 to about 2% by mass, and having 48% or larger total elongation determined by tensile test, wherein the steel satisfies:

$$Md(\gamma)=-30\sim 90$$

where, $$Md(\gamma)=551-462C(\gamma)-462N(\gamma)-9.2Si(\gamma)-8.1Mn(\gamma)-13.7Cr(\gamma)-18.5Mo(\gamma)-29Ni(\gamma)-29Cu(\gamma),$$

and each component is of γ phase.

2. The austenitic-ferritic stainless steel according to claim 1, wherein the stainless steel further comprises one or more of about 4% or less Mo and about 4% or less Cu, by mass.

3. The austenitic-ferritic stainless steel according to claim 1, wherein the stainless steel further comprises 0.1% or less Al by mass.

4. The austenitic-ferritic stainless steel according claim 1, wherein the stainless steel further comprises one or more of about 0.01% or less B, about 0.01% or less Ca, about 0.01% or less Mg, about 0.1% or less REM, and about 0.1% or less Ti, by mass.

* * * * *

UNITED STATES PATENT AND TRADEMARK OFFICE

CERTIFICATE OF CORRECTION

PATENT NO. : 8,562,758 B2
APPLICATION NO. : 10/587222
DATED : October 22, 2013
INVENTOR(S) : Fujisawa et al.

It is certified that error appears in the above-identified patent and that said Letters Patent is hereby corrected as shown below:

In the Specification

In Column 9

At line 20, please change "Ce(γ)" to -- Cr(γ) --.

Signed and Sealed this
Twenty-fourth Day of June, 2014

Michelle K. Lee

Michelle K. Lee
*Deputy Director of the United States Patent and Trademark Office*